US010821581B2

(12) United States Patent
Lee et al.

(10) Patent No.: US 10,821,581 B2
(45) Date of Patent: Nov. 3, 2020

(54) TORQUE LIMIT APPARATUS, ELECTRIC SCREWDRIVER HAVING THE SAME, AND METHOD THEREOF

(71) Applicants: Hyundai Motor Company, Seoul (KR); Kia Motors Corporation, Seoul (KR)

(72) Inventors: Myoung Seok Lee, Hwaseong-si (KR); Young Kook Lee, Seoul (KR); Joo Yong Yeo, Daegu (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 316 days.

(21) Appl. No.: 15/728,311

(22) Filed: Oct. 9, 2017

(65) Prior Publication Data

US 2018/0354108 A1 Dec. 13, 2018

(30) Foreign Application Priority Data

Jun. 8, 2017 (KR) ..... 10-2017-0071863

(51) Int. Cl.
*B25B 21/00* (2006.01)
*B25B 23/147* (2006.01)

(52) U.S. Cl.
CPC ..... *B25B 23/147* (2013.01); *B25B 21/00* (2013.01)

(58) Field of Classification Search
CPC ..... B25B 23/1422; B25B 21/00; B25B 23/14; B25F 5/001; H01C 10/23; H01C 10/28; H01C 10/46; H01C 13/02
USPC ..... 173/2, 5, 1, 176, 179, 180, 181, 217; 388/824
See application file for complete search history.

(56) References Cited

U.S. PATENT DOCUMENTS 4,041,362 A * 8/1977 Ichiyanagi ..... H02P 6/06 318/269
4,134,052 A * 1/1979 Wanlass ..... H02P 7/03 318/282
4,463,293 A * 7/1984 Hornung ..... B25B 23/14 318/284
5,847,530 A * 12/1998 Hill ..... H02P 6/08 318/599
6,945,337 B2 * 9/2005 Kawai ..... B25B 21/026 173/176
7,331,406 B2 * 2/2008 Wottreng, Jr. ..... B25B 23/045 173/176
8,427,084 B2 * 4/2013 Kobayashi ..... H02M 7/53873 318/255

(Continued)

FOREIGN PATENT DOCUMENTS

KR 10-2009-0062421 A 6/2009
KR 10-2011-0066228 A 6/2011

(Continued)

*Primary Examiner* — Thanh K Truong
*Assistant Examiner* — Patrick B Fry
(74) *Attorney, Agent, or Firm* — Morgan, Lewis & Bockius LLP

(57) ABSTRACT

A torque limit apparatus includes a user interface device that receives a speed setting value and a torque setting value of a motor from a user and outputs a state of the motor and a motor control device that controls a speed of the motor depending on speed set by the user and to interrupt an operation of the motor when torque of the motor reaches torque set by the user.

19 Claims, 23 Drawing Sheets

(56) References Cited

U.S. PATENT DOCUMENTS

| | | | | |
|---|---|---|---|---|
| 8,894,654 | B2 * | 11/2014 | Anderson | A61B 17/1626 606/80 |
| 9,337,764 | B2 * | 5/2016 | Yamashita | B02C 18/24 |
| 10,383,631 | B2 * | 8/2019 | Collings | A61B 17/07207 |
| 10,383,674 | B2 * | 8/2019 | Sexson | A61B 90/03 |
| 2009/0157245 | A1 | 6/2009 | Moon et al. | |
| 2010/0097732 | A1 | 4/2010 | Dean | |
| 2011/0241584 | A1 * | 10/2011 | He | H02P 6/181 318/400.09 |
| 2018/0036004 | A1 * | 2/2018 | Collings | A61B 17/07207 |

FOREIGN PATENT DOCUMENTS

| | | | |
|---|---|---|---|
| KR | 10-2015-0072014 | A | 6/2015 |
| KR | 10-2016-0058177 | A | 5/2016 |
| WO | WO 2015/073118 | A2 | 5/2015 |

* cited by examiner

<PRIOR ART>

TORQUE LIMIT APPARATUS, ELECTRIC SCREWDRIVER HAVING THE SAME, AND METHOD THEREOF

CROSS-REFERENCE TO RELATED APPLICATION

The present application claims priority to Korean Patent Application No. 10-2017-0071863, filed on Jun. 8, 2017, the entire contents of which is incorporated herein for all purposes by this reference.

BACKGROUND OF THE INVENTION

Field of the Invention

The present invention relates to a torque limit apparatus, an electric screwdriver having the same, and a method thereof, and more particularly, to a technology that is configured for electronically controlling torque of an electric screwdriver.

Description of Related Art

An electric screwdriver is a useful tool that is rapidly and conveniently used when tightening a slot-type screw, a cross-type screw, or a hex screw. A conventional electric screwdriver is similar to a general electric screwdriver inserting a driver tip. The conventional electric screwdriver may rotate depending on driving setting set by a user without limitation of power of the electric screwdriver. When the driving setting is not properly cared, the conventional electric screwdriver damages screw groove or thread of a nut because the electric screwdriver continuously rotates with strong power even though a screw is completely tightened.

Accordingly, in the case where the user employs an electric screwdriver, the user has to pay attention to employ the electric screwdriver. Accordingly, a function of limiting torque is disposed in the electric screwdriver such that driving force greater than reference force set in advance by the user is not applied to a screw when the driving force that is not less than the reference force is applied to the screw. Generally, a torque limit apparatus of an electric screwdriver operates on mechanical principles, and is complex and bulky. In addition, the conventional electric screwdriver may generate flame, dust, or noise of a brush by use of a universal motor. The brush may be periodically replaced because the life of the brush is short.

There is an electric screwdriver in which a mechanical torque limit apparatus is replaced by an electric torque limit apparatus. The electric torque limit apparatus detects a current flowing into a motor to detect torque of a motor. The electric torque limit apparatus uses a resistor to detect the current. In the instant case, since a large current flowing into the motor needs to pass through the resistor, a cement resistor having a large permissible power may be used. As a result, a resistance element generates heat or the volume thereof may increase. In particular, efficiency of a battery may be reduced depending on the heat. The heat issue will be resolved by use of a detector that detects only a current. However, the volume of the detector may increase and the cost of the detector also may increase.

The information disclosed in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a torque limit apparatus that includes an interface allowing a user to adjust torque limit magnitude of a torque limit apparatus of a BLDC motor and performs electric torque limit by estimating torque through a variance in Pulse Width Modulation (PWM) of a BLDC motor without a separate detector to decrease the volume and weight of the motor, an electric screwdriver including the same, and a method thereof.

Various aspects of the present invention provide a torque limit apparatus that allows a motor to rotate in a reverse direction such that a driver is easily released from a screw after the screw is tightened, an electric screwdriver including the same, and a method thereof.

The technical problems to be solved by the present inventive concept are not limited to the aforementioned problems, and any other technical problems not mentioned herein will be clearly understood from the following description by those skilled in the art to which the present invention pertains.

According to an exemplary embodiment of the present invention, a torque limit apparatus may include a user interface device configured to receive a speed setting value and a torque setting value of a motor from a user and to output a state of the motor, and a motor control device configured to control speed of the motor depending on speed set by the user and to interrupt an operation of the motor when torque of the motor reaches torque set by the user.

According to various aspects of the present invention, the user interface device may include a speed setting device configured to receive the speed setting value of the motor from the user and a torque setting device configured to receive the torque setting value of the motor from the user.

According to various aspects of the present invention, the speed setting device may include a trigger-type handle, a location of which is adjusted by the user and a variable resistor coupled to the trigger-type handle. The speed setting device may divide the speed of the motor into a plurality of steps and sets the speed of the motor to one of the plurality of steps by moving the trigger-type handle.

According to various aspects of the present invention, the torque setting device may include a circular handle, a location of which is adjusted by the user and a variable resistor coupled to the circular handle. The torque setting device may divide the torque into a plurality of steps and sets the torque to one of the plurality of steps by moving the circular handle.

According to various aspects of the present invention, the user interface device may further include a direction setting switch configured to receive a direction of rotation of the motor by the user.

According to various aspects of the present invention, the direction setting switch may be a single single-pole single-throw (SPST) push switch.

According to various aspects of the present invention, the user interface device may further include an output device configured to display the state of the motor and to output alarm when the torque of the motor reaches the torque set by the torque setting device while the motor is driven.

According to various aspects of the present invention, the motor control device may determine that a screw is completely tightened by the motor, and may output alarm sound or an alarm lamp through the user interface device, when the torque of the motor reaches the torque set by the user.

According to various aspects of the present invention, the motor control device rotates the motor by a specific angle in a reverse direction when it is determined that the screw is completely tightened by the motor.

According to various aspects of the present invention, the motor control device may include a power transistor configured to output a pulse width modulation (PWM) signal for determining rotation speed of the motor to the motor, a position detector configured to detect the speed of the motor, and a processor. The processor may be configured to drive the power transistor depending on the speed set by the user, to control the power transistor such that the speed of the motor detected by the position detector is the same as the speed set by the user, and to interrupt the operation of the motor when the torque of the motor reaches the torque set by the user.

According to various aspects of the present invention, the processor may include a speed detecting device configured to detect the speed of the motor detected from the position sensor, a speed comparing device configured to compare the speed detected by the speed detecting device with the speed set by the user, a PWM command device configured to output a value for determining a PWM duty cycle depending on the comparison result of the speed comparing device, and a PWM duty cycle comparing device configured to compare torque set depending on the output value of the PWM command device with the torque set by the user.

According to various aspects of the present invention, the PWM comparing device may output alarm sound or turns on an alarm lamp through the user interface device when the torque set depending on the output value of the PWM command device is the same as the torque set by the user.

According to various aspects of the present invention, the torque limit apparatus may further include a power supply device configured to power the motor.

According to another exemplary embodiment of the present invention, a brushless DC (BLDC) electric screwdriver may include a BLDC motor and a torque limit apparatus. The torque limit apparatus may be configured to receive a speed setting value and a torque setting value of the BLDC motor from a user, to compare detected speed of the BLDC motor with speed set by the user to output a PWM signal for the BLDC motor speed control, to compare torque detected from a variation of the PWM signal with torque set by the user, and, when the torque detected from the variation of the PWM signal is the same as the torque set by the user, to interrupt an operation of the BLDC motor.

According to another exemplary embodiment of the present invention, a torque limit method may include receiving a speed setting value and a torque setting value of a motor from a user, detecting current speed of the motor, comparing the current speed of the motor with speed set by the user to control speed of the motor, detecting current torque of the motor, and interrupting an operation of the motor when the current torque of the motor reaches torque set by the user.

According to various aspects of the present invention, the method may include outputting a state of the motor by use of alarm sound or an alarm lamp.

According to various aspects of the present invention, the controlling of the speed of the motor may include decreasing a PWM duty cycle for driving the motor when the current speed of the motor is greater than the speed set by the user and increasing the PWM duty cycle for driving the motor when the current speed of the motor is less than the speed set by the user.

According to various aspects of the present invention, the detecting of the current speed of the motor may include detecting the torque by use of a variance of PWM duty cycle for driving the motor that is based on the result obtained by comparing the current speed of the motor with the speed set by the user.

According to various aspects of the present invention, the method may further include rotating the motor by a specific angle in a reverse direction when the motor is interrupted when the current torque of the motor reaches the torque set by the user.

According to various aspects of the present invention, the interrupting of the operation of the motor may include decreasing an excess counter variable when torque excess in which the current torque of the motor is greater than the torque set by the user is detected, determining that the current torque of the motor definitively reaches the torque set by the user, when the excess counter variable is "0", and initializing the excess counter variable when the determination is completed.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
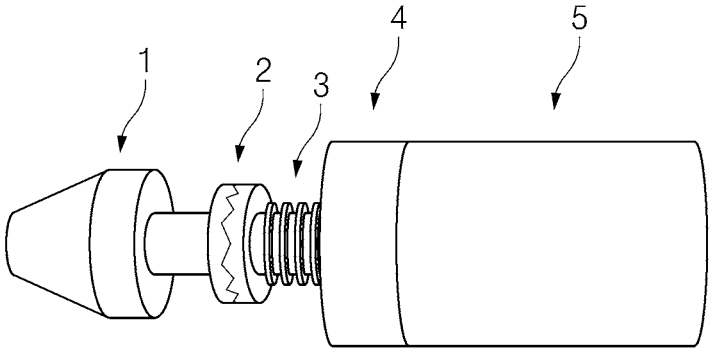
FIG. 1 is a view illustrating a mechanical torque limit apparatus of a conventional electric screwdriver.

It may be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In describing elements of exemplary embodiments of the present invention, the terms 1st, 2nd, first, second, "A", "B", (a), (b), and the like may be used herein. These terms are only used to distinguish one element from another element, but do not limit the corresponding elements irrespective of the order or priority of the corresponding elements. Unless otherwise defined, all terms used herein, including technical or scientific terms, have the same meanings as those generally understood by those skilled in the art to which the present invention pertains. It will be understood that terms used herein should be interpreted as having a meaning that is consistent with their meaning in the context of the present disclosure and the relevant art and will not be interpreted in an idealized or overly formal detect unless expressly so defined herein.

Below, various embodiments of the present invention will be described in detail with reference to FIGS. 1 to 7. Hereinafter, a motor according to an exemplary embodiment of the present invention indicates a brushless DC (BLDC) motor.

Figure 2:
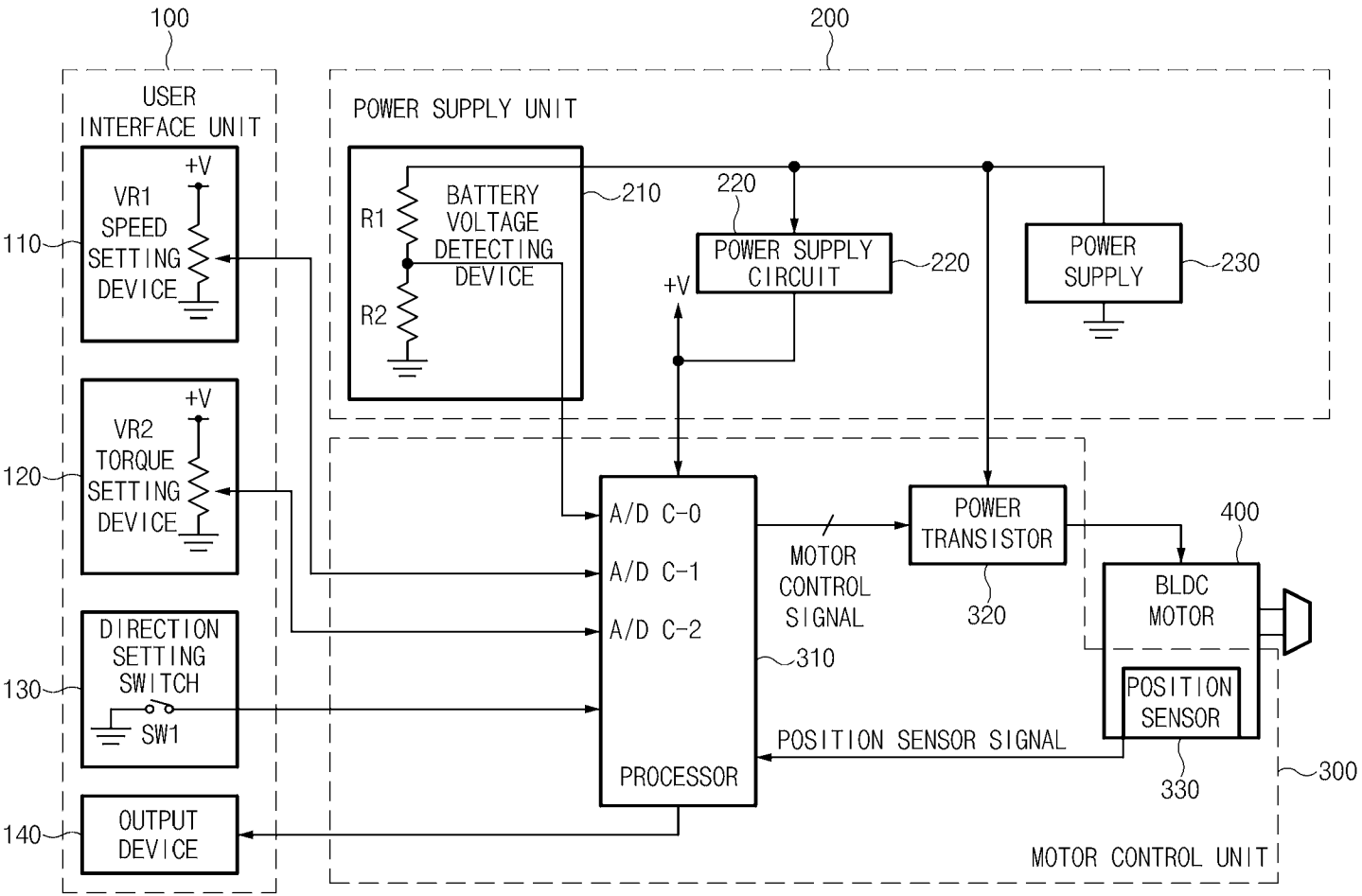
FIG. 2 is a block diagram illustrating a BLDC electric screwdriver including an electric torque limit apparatus, according to an exemplary embodiment of the present invention.
Figure 3A:
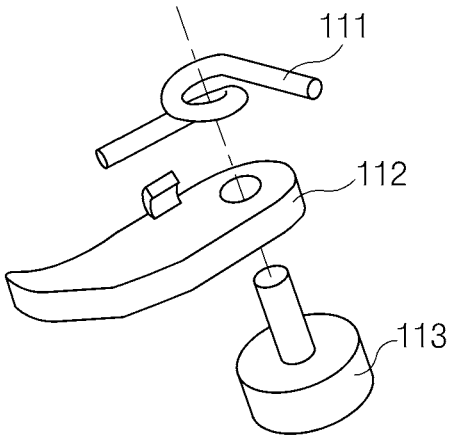
FIG. 3A is a separated perspective view of a speed setting device, according to an exemplary embodiment of the present invention.
Figure 3B:
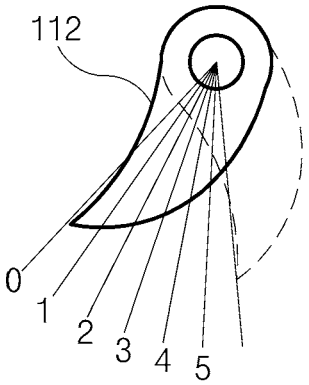
FIG. 3B is a view illustrating an operation range of the speed setting device, according to an exemplary embodiment of the present invention.
Figure 4A:
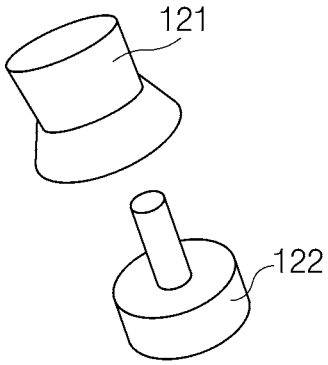
FIG. 4A is a separated perspective view of a torque setting device, according to an exemplary embodiment of the present invention.
Figure 4B:
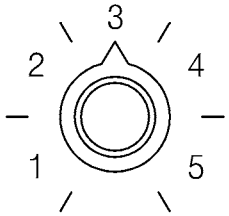
FIG. 4B is a view illustrating an operation range of the torque setting device, according to an exemplary embodiment of the present invention.
Figure 5A:
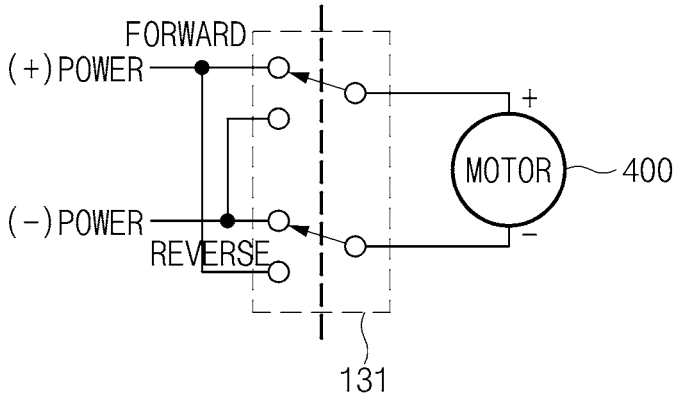
FIG. 5A is a circuit diagram of a direction setting switch, according to an exemplary embodiment of the present invention.
Figure 5B:
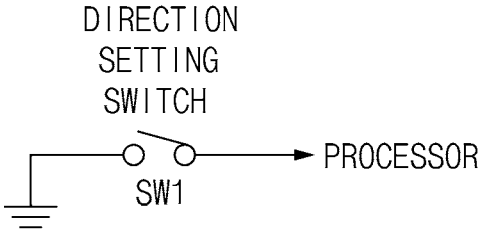
FIG. 5B is a circuit diagram of a direction setting switch, according to another exemplary embodiment of the present invention.

FIG. 2 is a block diagram illustrating a BLDC electric screwdriver including an electric torque limit apparatus, according to an exemplary embodiment of the present invention. FIG. 3A is a separated perspective view of a speed setting device, according to an exemplary embodiment of the present invention. FIG. 3B is a view illustrating an operation range of the speed setting device, according to an exemplary embodiment of the present invention. FIG. 4A is a separated perspective view of a torque setting device, according to an exemplary embodiment of the present invention. FIG. 4B is a view illustrating an operation range of the torque setting device, according to an exemplary embodiment of the present invention. FIG. 5A is a circuit diagram of a direction setting switch, according to an exemplary embodiment of the present invention. FIG. 5B is a circuit diagram of a direction setting switch, according to another exemplary embodiment of the present invention.

Figure 6:
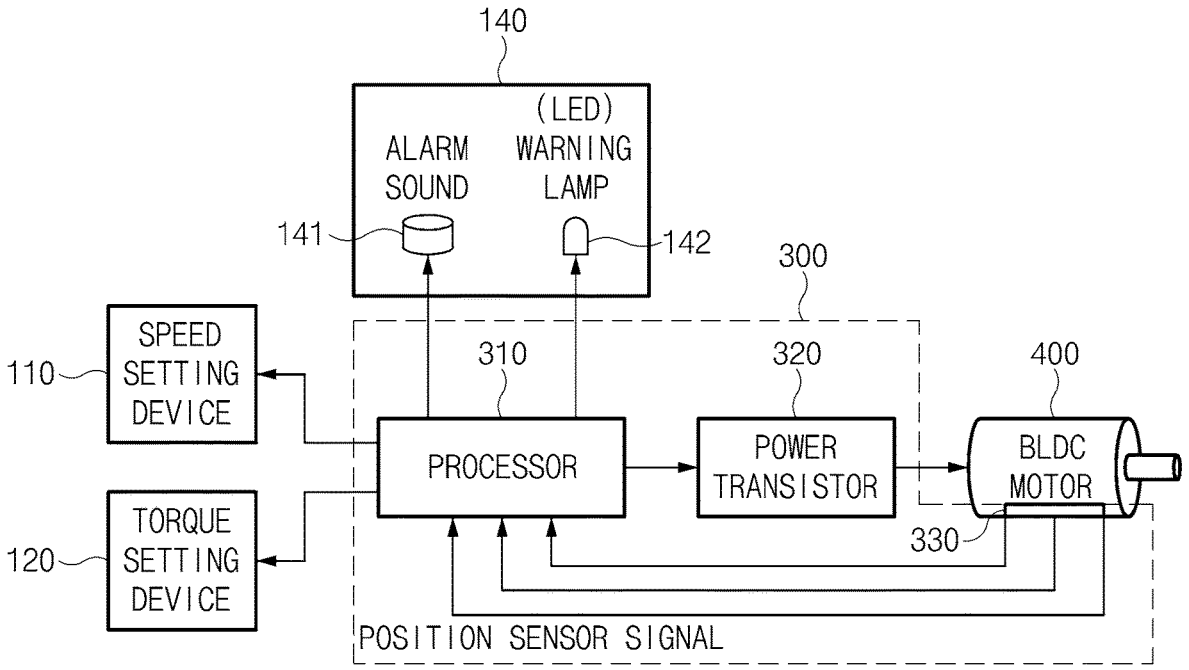
FIG. 6 is a block diagram illustrating a detailed configuration of a motor control device of FIG. 2, according to an exemplary embodiment of the present invention.
Figure 7:
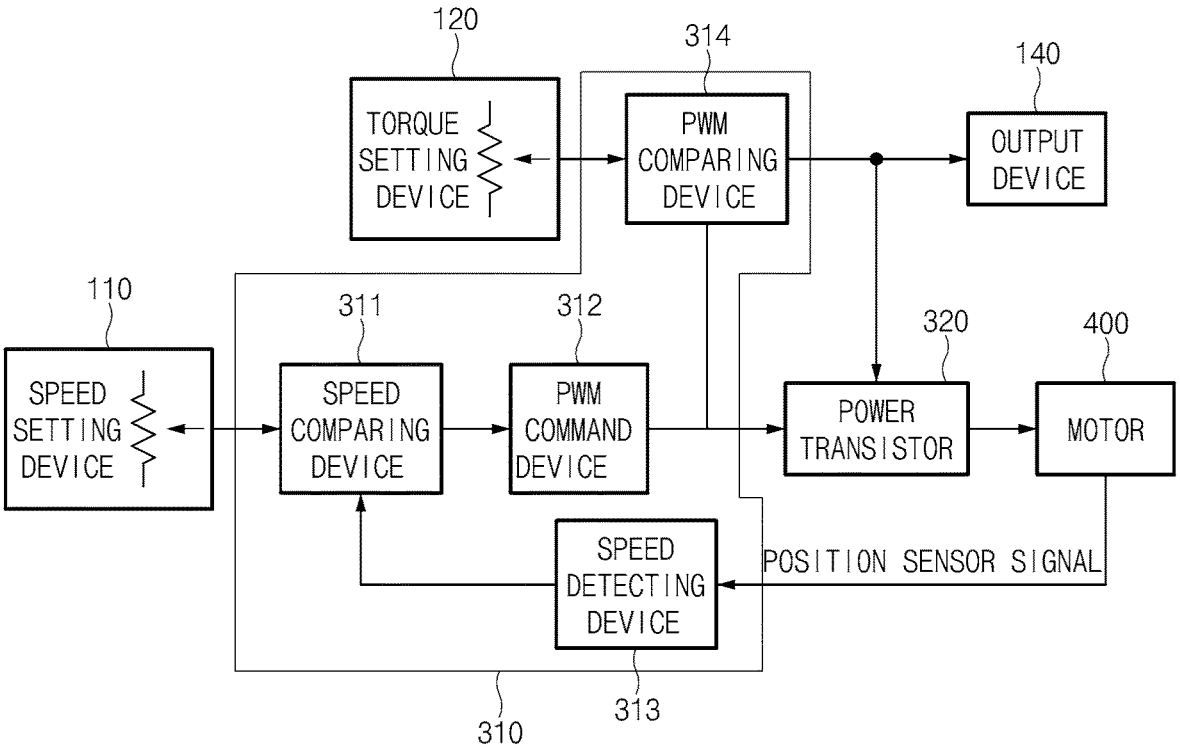
FIG. 7 is a block diagram illustrating a detailed configuration of a processor, according to an exemplary embodiment of the present invention.
Figure 8:
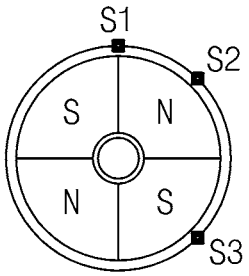
FIG. 8 is a view illustrating a detector location for detecting speed of a BLDC motor, according to an exemplary embodiment of the present invention.
Figure 9:
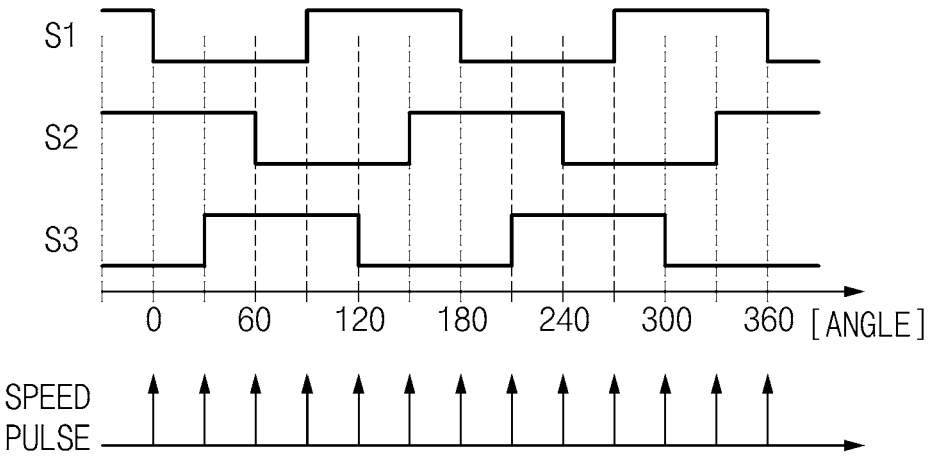
FIG. 9 is a timing diagram of a speed detection signal of a BLDC motor, according to an exemplary embodiment of the present invention.

FIG. 6 is a block diagram illustrating a detailed configuration of a motor control device of FIG. 2, according to an exemplary embodiment of the present invention. FIG. 7 is a block diagram illustrating a detailed configuration of a processor, according to an exemplary embodiment of the present invention. FIG. 8 is a view illustrating a detector location for detecting speed of a BLDC motor, according to an exemplary embodiment of the present invention. FIG. 9 is a timing diagram of a speed detection signal of a BLDC motor, according to an exemplary embodiment of the present invention.

Referring to FIG. 2, an electric torque limit apparatus according to an exemplary embodiment of the present invention may include a user interface device 100, a power supply device 200, and a motor control device 300.

The user interface device 100 may provide an interface that allows a user to adjust speed, to set torque, or to adjust a directional switch, and may display states of an electric torque limit apparatus and a device provided with the electric torque limit apparatus to alarm the user.

To the present end, the user interface device 100 may include a speed setting device 110, a torque setting device 120, a direction setting switch 130, and an output device 140.

The speed setting device 110 may have a configuration that allows the user to adjust the speed of the BLDC motor. Referring to FIG. 3A, the speed setting device 110 may have a structure in which a spring 111, a handle 112, and a variable resistor 113 are coupled. In the instant case, the handle 112 may be implemented with a trigger-type structure. Referring to FIG. 3B, a speed step may be set depending on how hard a user pulls the handle 112. That is, the speed step may be divided into six steps (from step 0 to step 5) from a low step to a high step. The speed may be set by setting the handle 112 such that the handle 112 is placed at a desired step of the six steps (from step 0 to step 5). In the instant case, step 0 is a stop state where the speed of the motor is "0", and the speed increases between step 1 and step 5. The handle 112 may be hooked and fixed for each step of the speed setting device 110 or click feeling may be provided to the handle 112. The six steps (from step 0 to step 5) are illustrated in FIG. 3B. However, the speed step may be divided into steps greater than six steps.

The torque setting device 120 may include a configuration for setting how much torque the user stops operating the BLDC motor. Referring to FIG. 4A, the torque setting device 120 may be implemented to couple a circular handle 121 to a variable resistor 122. As illustrated in FIG. 4B, the torque setting device 120 may set a torque step that is divided into steps. A user may set the torque step such that an arrow of the handle 121 is placed in a desired area of step 1 to step 5 by turning the handle 121. In the instant case, step 5 may be the maximum location at which the motor is not automatically stopped. Five steps are illustrated in FIG. 4B. However, the speed step may be divided into steps greater than five steps.

The direction setting switch 130 may include a configuration that allows the user to set whether a BLDC motor 400 rotates in the forward direction or in the reverse direction thereof.

Referring to FIG. 5A, the conversion between forward and reverse directions may be controlled by changing polarity of the motor using a double-pole double-throw (DPDT) switch 131. However, the DPDT switch is complex and expensive. As illustrated in FIG. 5B, only a simple single-pole single-throw (SPST) push switch may be mounted, and software of a processor 310 may control the conversion between forward and reverse directions. According to an exemplary embodiment of the present invention, when the reverse direction in which a screw is loosened is selected, an option in which torque is automatically and maximally set may be set because the processor 310 is used.

The output device 140 may display a state of the motor including speed of the motor, a power state, a motor driving direction (a forward direction or a reverse direction), or a charging state. In the case where torque of the motor reaches set torque when a screw is tightened, the output device 140 may output alarm while the motor is stopped. To the present end, the output device 140 may be implemented with a display device, an alarm lamp, or a speaker for outputting alarm sound.

The power supply device 200 may control to power a torque limit apparatus and a device including the same.

To the present end, the power supply device 200 may include a battery voltage detecting device 210, a power supply circuit 220, and a power supply 230.

In the case where the power supply 230 is a battery, the battery voltage detecting device 210 may detect a charging state of a battery and may notify the processor 310 in the motor control device 300 of the detected charging state.

The power supply circuit 220 may generate power for supplying the power to the motor control device 300.

The power supply 230 may include a battery or a main power supply using electric power. In the case where a battery is used, the charging state is detected while the battery is being charged. When the charging is completed, the charging is interrupted, and the fact that the charging is completed may be displayed through the output device 140 of the user interface device 100.

Referring to FIGS. 2 and 6, the motor control device 300 may control the BLDC motor depending on a command input through the user interface 100 and may notify the user interface 100 of a state of the BLDC motor.

To the present end, the motor control device 300 includes the processor 310, a power transistor 320, and a position detector 330.

The processor 310 that is a microprocessor may output a control signal to the power transistor 320 in conjunction with the user interface device 100.

The processor 310 detects speed and torque voltage set by the user interface device 100 by analog to digital conversion. When the user pulls the trigger-type handle 112 to increase speed setting voltage, the processor 310 allows the speed of the BLDC motor 400 to increase by driving the power transistor 320. Afterwards, when torque of the BLDC motor 400 reaches the set torque, the processor 310 determines that a screw is completely tightened. As illustrated in FIG. 6, the processor 310 allows the output device 140 to notify a user that a task is completed, by use of alarm sound 141, or a warning lamp (LED) 142.

The processor 310 corrects the speed of the BLDC motor 400 by comparing speed set by the user through the speed setting device 110 with the speed of the BLDC motor 400 detected from the position detector 330. When the detected speed of the BLDC motor 400 is slower than the speed set by the user, the processor 310 allows the BLDC motor 400 to rotate at a higher speed by increasing a pulse width modulation (PWM) duty cycle. On the other hand, when the detected speed of the BLDC motor 400 is faster than the speed set by the user, the processor 310 allows the BLDC motor 400 to rotate at a low speed by decreasing the PWM duty cycle. The constant speed operation is controlled such that the rotation speed of the BLDC motor 400 is substantially equal to the speed set by the user, by repeating the above-described operation.

The processor 310 may detect the torque of the BLDC motor 400 from the variance of the PWM duty cycle to determine whether the torque of the BLDC motor 400 reaches the torque set by the user, without including a separate current detector or a separate torque sensor.

That is, when load torque increases in a state where the BLDC motor 400 operates in a normal state, the rotation speed of the BLDC motor 400 decreases. Accordingly, to compensate the rotation speed of the BLDC motor 400, the motor control device 300 allows the rotation speed of the BLDC motor 400 to increase by increasing the PWM duty cycle.

On the other hand, when the load torque decreases, the rotation speed of the BLDC motor 400 increases. Accordingly, to compensate the rotation speed of the BLDC motor 400, the motor control device 300 allows the rotation speed of the BLDC motor 400 to decrease by decreasing the PWM duty cycle. As a result, since the PWM duty cycle varies depending on the load torque, an amount of load torque may be detected by use of the variance of the PWM duty cycle. Referring to FIG. 7, whether the torque of the BLDC motor 400 reaches the torque set by the user may be determined by comparing the torque set by the user through the torque setting device 120 with the torque detected depending on the variance of the PWM during the constant speed operation. Accordingly, according to an exemplary embodiment of the present invention, the torque of the BLDC motor 400 may be indirectly detected through a relation between revolution per minute (RPM) of the BLDC motor 400 and a PWM duty command, without including the separate torque detector or the current sensor.

To the present end, referring to FIG. 7, the processor 310 includes a speed comparing device 311, a PWM command device 312, a speed detecting device 313, and a PWM comparing device 314.

The speed comparing device 311 compares the speed, which is set by the user through the speed setting device 110, with the speed of the BLDC motor 400 detected through the position detector 330.

The PWM command device 312 controls the PWM duty cycle depending on a speed difference value (a difference value between the set speed and the detected speed) detected by the speed comparing device 311.

The speed detecting device 313 detects the speed of the BLDC motor 400 by use of a detection signal received from the position detector 330 embedded in the BLDC motor 400.

Referring to FIG. 8, according to an exemplary embodiment of the present invention, rotor position detectors S1, S2, and S3 are embedded and used as the position detector 330 without using a separate detector including an optical encoder to detect the speed of the BLDC motor 400, and the speed is detected from signals of the rotor position detectors S1, S2, and S3. In the case of a 4 poles 3-phase BLDC motor in FIG. 8, as illustrated in FIG. 9, waveforms of the position detectors S1, S2, and S3 occur.

When both a rising edge portion and a falling edge portion of the waveforms are detected, the rising edge portion and the falling edge portion may be used as a speed detecting pulse. In the case of pulses illustrated in FIG. 9, 12 pulses per rotation of the motor are output. When the motor rotates at one revolution per second, that is 60 RPM, the pulse is detected at 12 Hz. The function may be implemented simply by use of a pin-change interrupt (PCINT) function of a microprocessor or an external interrupt function.

The PWM comparing device 314 may determine whether the torque of the BLDC motor 400 reaches the torque set by the user, by comparing torque detected from the variance of the PWM output by the PWM command device 312 with the torque set by the torque setting device 120. In the instant case, when it is determined that the torque of the BLDC motor 400 reaches the torque set by the user, the alarm sound is output or an alarm light is turned on by operating the output device 140.

The power transistor 320 outputs a PWM signal for determining the rotation speed of the BLDC motor 400 to the BLDC motor 400.

The position detector 330 embedded in the BLDC motor 400 detects the speed of the BLDC motor 400 and transmits the detection result to the processor 310.

Under control of the motor control device 300, the BLDC motor 400 tightens or loosens a screw by rotating in a forward direction or a reverse direction thereof.

According to an exemplary embodiment of the present invention, the BLDC electric screwdriver having the above-described configuration detects the speed of the motor without a separate sensor, allows the motor to operate at a speed set by the user, and interrupts an operation of the motor to output alarm sound or an alarm light for providing notification that a screw is completely tightened, when the torque detected by use of the variation of a PWM signal is the same as the torque set by the user. Accordingly, the volume and weight of an electric screwdriver may be reduced compared with a mechanical torque limit apparatus and convenience of the user may increase.

Hereinafter, Table 1 illustrates a data setting table when the speed includes 5-step speed control and 5-step torque control.

TABLE 1

| | Torque step | | | | |
|---|---|---|---|---|---|
| Speed step | 1 | 2 | 3 | 4 | 5 |
| 1 | 130 | 140 | 150 | 160 | unlimited |
| 2 | 150 | 160 | 170 | 180 | Unlimited |
| 3 | 170 | 180 | 190 | 200 | Unlimited |
| 4 | 190 | 200 | 210 | 220 | Unlimited |
| 5 | 210 | 220 | 230 | 240 | Unlimited |

according to an exemplary embodiment of the present invention, the speed set by the user is controlled by use of 5 steps, and the torque is controlled by use of 5 steps, a speed setting look-up table of 5 steps for generating the set speed and a torque look-up table including the total 25 types of combinations that is set to the torque of 5 steps with respect to speed of one step are illustrated in Table 1.

For example, when the motor is being used after the user sets the speed setting of the motor to step 2, the motor control device 300 performs control to maintain the PWM at 140 and the speed at 60. When a load is applied and the speed of the motor decreases, the motor control device 300 increases the PWM duty cycle to compensate the speed of the motor. In the instant case, when the PWM, which is increasing to maintain the speed at 60 when the user sets the torque step to "3", exceeds 170 of Table 1, it is determined that a limit point is reached. Accordingly, the motor control device 300 allows an operation of the motor to be interrupted and allows alarm sound to ring. In the instant case, in the case where the torque setting is set to step 5, the motor may operate at the maximum speed without limitation of the PWM.

Figure 10A:
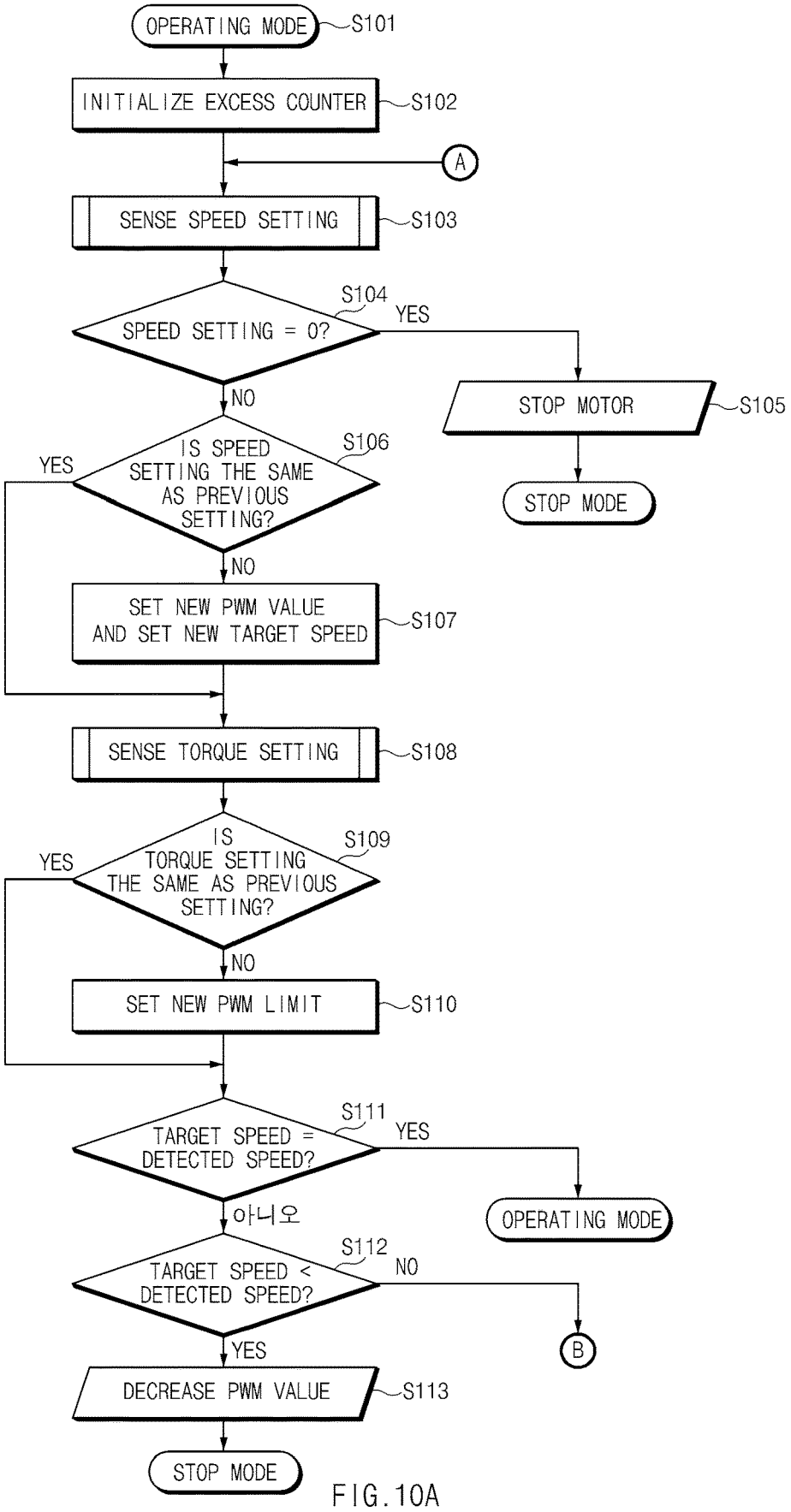
FIG. 10A is a flowchart illustrating an operating mode method of a BLDC electric screwdriver, according to an exemplary embodiment of the present invention.
Figure 10B:
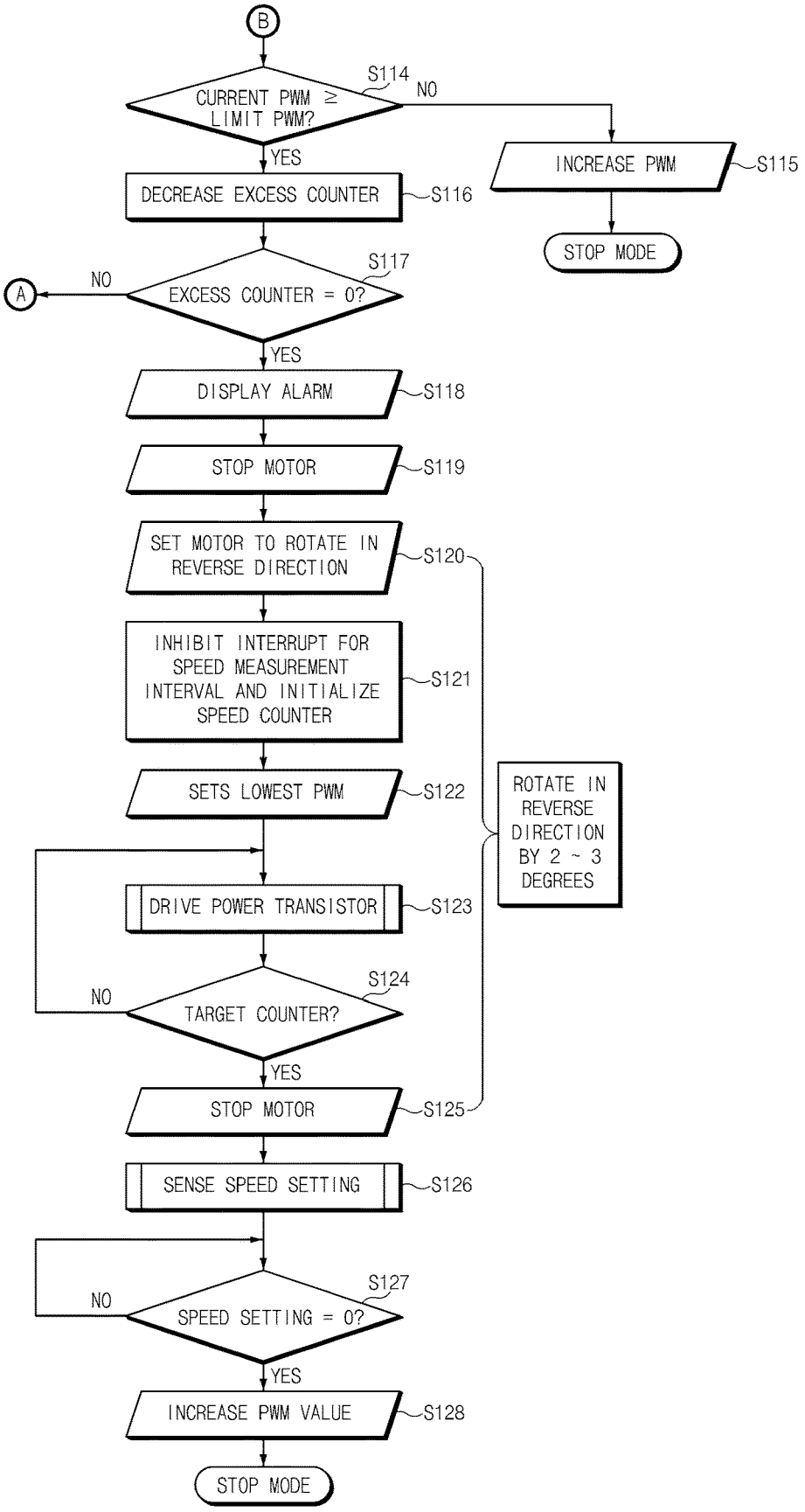
FIG. 10B is a flowchart illustrating the operating mode method connected in procedures of "A" and "B" of FIG. 10A.

Hereinafter, FIG. 10A is a flowchart illustrating an operating mode method of a BLDC electric screwdriver, according to an exemplary embodiment of the present invention. FIG. 10B is a flowchart illustrating the operating mode method connected in procedures of "A" and "B" of FIG. 10A. Referring to FIGS. 10A and 10B, the operating mode method of the electric screwdriver according to an exemplary embodiment of the present invention will be described in detail.

The BLDC electric screwdriver according to an exemplary embodiment of the present invention operates in one of a stop mode and an operating mode. The stop mode is a state where speed setting is "0" even though power is applied to the motor, that is, a state where the motor is not used. The processor 310 detects speed setting and torque setting. When the speed setting is not less than step 1, the processor 310 controls the BLDC electric screwdriver to enter the operating mode. When the speed setting is less than step 1, the processor 310 repeats detecting the speed setting and the torque setting.

The operating mode is a state where the user employs an electric screwdriver. The processor 310 detects the speed setting. When the speed setting is less than step 1, a user stops operating the motor and the stop mode is entered. When the speed setting is not less than step 1, the operating mode is entered.

When the operating mode is entered in operation S101, in operation S102, the torque limit apparatus initializes an excess counter counting the number of times that the maximum torque is exceeded.

Since the user changes the speed setting while using the electric screwdriver, the torque limit apparatus detects the speed setting in operation S103 and determines a value of the speed setting in operation S104. When the speed setting is "0", the torque limit apparatus stops the motor and returns to the stop mode in operation S105 because the user stops using the electric screwdriver.

In the meantime, when the speed setting of the motor is not "0", the torque limit apparatus determines whether the speed setting is the same as the previous setting in operation S106. When the speed setting is not the same as the previous setting, i.e., when the speed setting is changed, in operation S107, the torque limit apparatus reconfigures a PWM value and a target speed corresponding to the changed speed setting. When the speed setting is still the same as the previous setting, the new setting is skipped.

Afterwards, since the user changes the torque setting while using the electric screwdriver, the torque limit apparatus detects the torque setting in operation S108 and determines whether the torque setting is the same as the previous setting in operation S109. When the torque setting is not the same as the previous setting, i.e., when the torque setting is changed, the torque limit apparatus reconfigures a PWM limit value corresponding to the changed torque setting in operation S110. When the torque setting is still the same as the previous setting, the new setting is skipped.

In operation S111, the torque limit apparatus compares the target speed set by the user with detected speed currently detected from the motor. When the target speed is the same as the detected speed, the torque limit apparatus repeats the operating mode without performing a control operation. When the detected speed is faster than the target speed in operation S112, the torque limit apparatus decreases the PWM duty cycle and repeats the operating mode in operation S113. When the detected speed is slower than the target speed, the torque limit apparatus proceeds to step B (S114 of FIG. 10B). Afterwards, in operation S114, the torque limit apparatus detects whether a value of the PWM currently applied to the motor is not less than a value of limited PWM duty cycle, i.e., whether the PWM duty cycle reaches the limited PWM duty cycle. When the PWM duty cycle does not reach the limited PWM duty cycle, in operation S115, the torque limit apparatus increases the PWM duty cycle and repeats the operating mode.

When the PWM duty cycle already reaches the limited PWM duty cycle, in operation S116, the torque limit apparatus decreases the excess counter. In operation S117, the torque limit apparatus determines whether the decreased excess counter reaches "0". When the excess counter does not reach "0", the procedure proceeds to step A (S103 of FIG. 10B) and repeats the present process.

When the excess counter reaches "0", the present indicates that a state of the electric screwdriver completely reaches the set torque. Accordingly, the torque limit apparatus displays alarm for providing notification that a task is ended in operation S118 and stops the motor in operation S119. Afterwards, the electric screwdriver rotates in a reverse direction by 2~3 degrees such that a tools of the electric screwdriver is easily removed.

That is, to rotate in the reverse direction by 2~3 degrees, the torque limit apparatus sets the motor in the reverse direction in operation S120. To measure a rotational angle, in operation S121, the torque limit apparatus inhibits the interrupt for speed measurement interval and initializes a speed counter variable. In operation S122, the torque limit apparatus sets the motor to the lowest PWM such that the motor rotates at a slow speed in the reverse direction thereof. Since the motor already stops, in operation S123, the torque limit apparatus rotates the motor in the software manner through a transistor driving routine used when the motor operates. In the instant case, since the interrupt for speed measurement interval is prohibited, the speed counter variable is not automatically initialized. Only the speed counter variable increases by the interrupt PCINT according to the change of the rotor position detector due to the rotation of the motor. When the speed counter variable is verified, how much the motor rotates may be detected.

In operation S124, the torque limit apparatus determines whether the target counter is reached. When the target counter is reached, in operation S125, the torque limit apparatus stops the motor. In operation S126, the torque limit apparatus detects speed setting. When the speed setting is "0" in operation S127, in operation S128, the torque limit apparatus turns off alarm.

To summarize the operating mode, immediately after entering the operating mode from the stop mode, the torque limit apparatus sets PWM duty cycle and sets target speed, based on a speed setting look-up table (Table 1) corresponding to the speed setting. In addition, the torque limit apparatus controls the motor such that speed of the motor is the same as the target speed. That is, when the detected speed is faster than the target speed, the torque limit apparatus decreases the PWM duty cycle. When the detected speed is slower than the target speed, the torque limit apparatus increases the PWM duty cycle. When controlling to increase the PWM duty cycle, the torque limit apparatus determines whether the increased PWM duty cycle exceeds limit torque in the torque setting look-up table. When not exceeding the limit torque, the torque limit apparatus keeps the controlling. When exceeding the limit torque, the present indicates that an output of the motor reaches a target value. In the instant case, the torque limit apparatus stops the motor and rings alarm. Afterwards, the motor is controlled to rotate in the reverse direction such that the tools are easily removed.

Figure 11:
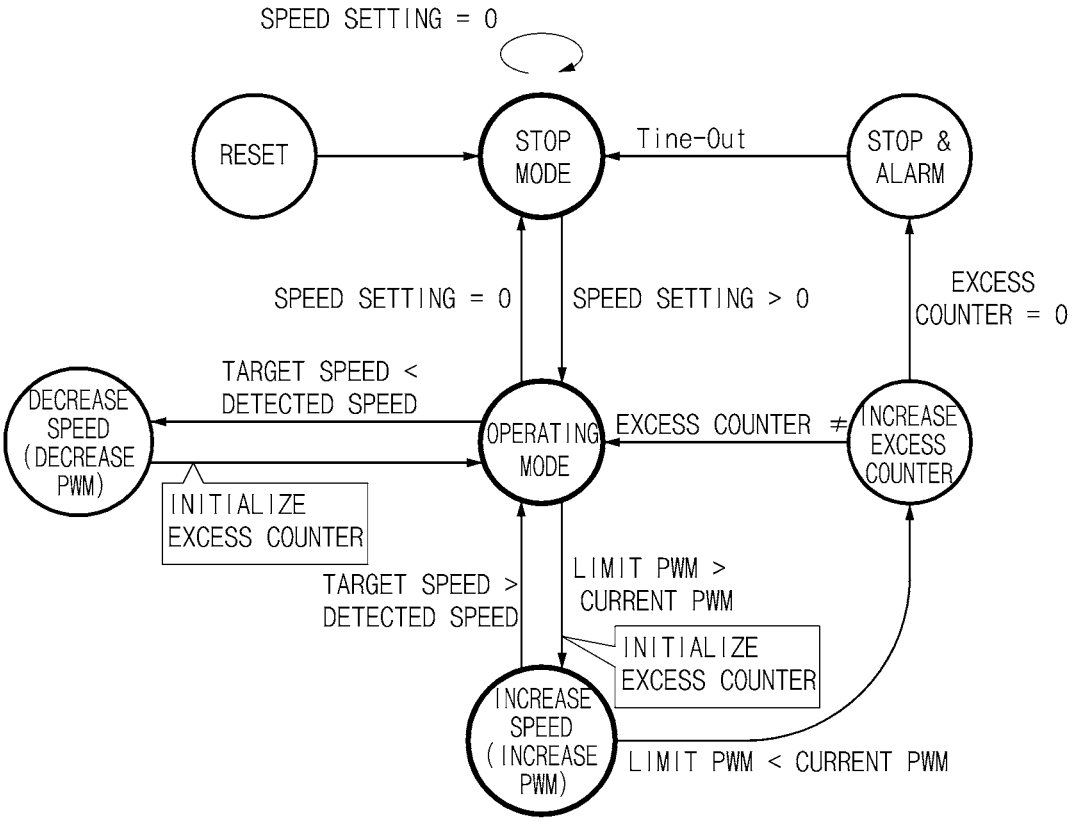
FIG. 11 is a diagram illustrating a control state machine of an electric torque limit apparatus, according to an exemplary embodiment of the present invention.

FIG. 11 is a diagram illustrating a control state machine of an electric torque limit apparatus, according to an exemplary embodiment of the present invention.

Referring to FIG. 11, a stop mode is entered at an initial time point RESET when power is applied to an electric screwdriver. Speed setting and torque setting is detected in the stop mode. When the detected speed setting is "0", the stop mode is maintained. When the speed setting is not less than "0", the operating mode is entered.

When the operating mode is entered, the target speed according to the speed setting is compared with the detected speed. When the detected speed is not less than the target speed (i.e., when the motor rotates such that speed of the motor is faster than the target speed), the speed decreases, that is, a PWM duty cycle decreases. When the detected speed is less than the target speed (when load is applied to a motor and the motor rotates at a low speed), the speed increases, that is, the PWM duty cycle increases. Afterwards, when the increased PWM duty cycle is less than the limited PWM duty cycle set by torque setting, this indicates that target torque is not reached yet. Accordingly, the torque limit apparatus maintains the operating mode. When the increased PWM duty cycle is greater than the limited PWM duty cycle (the state is referred to as "torque excess" for descriptive convenience), it is determined that the target torque is reached, and the increased PWM duty cycle is restored to a previous state before being increased.

However, in the instant case, a load instantaneously increases and then decreases due to the increase in the friction of a screw while the electric screwdriver is actually used. To detect that torque excess is maintained during a specific time period, an excess counter variable decreases and the operating mode is returned when torque excess is detected. Afterwards, when the torque excess is detected again, the excess counter decreases. When the excess counter is "0", it is determined that a target is reached. The constant associated with whether torque excess is detected the specific number of times when the operating mode is entered, is stored in the excess counter. Whenever it is determined that the torque excess is not reached, the excess counter is initialized again.

For example, in the case where the excess counter is set to "5" when the operating mode is entered, when first torque excess occurs, the excess counter decreases to "4". However, since the excess counter is not "0", the operating mode is returned. When the torque excess successively occurs again, the excess counter decreases to "3". When it is determined that the torque excess does not occur because the load is reduced after the operating mode is returned, the excess counter is initialized to "5" again. That is, it is determined that the target torque is definitively reached when the torque excess is successively detected 5 times.

Figure 12:
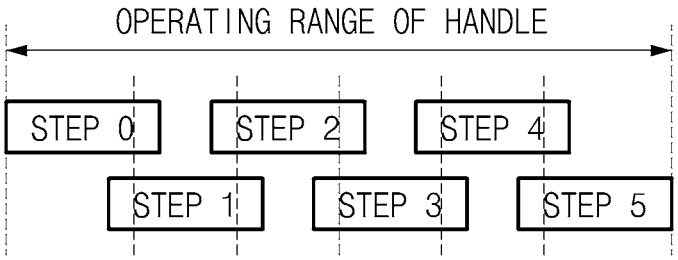
FIG. 12 is a diagram for describing a method for determining speed setting, according to an exemplary embodiment of the present invention.
Figure 13:
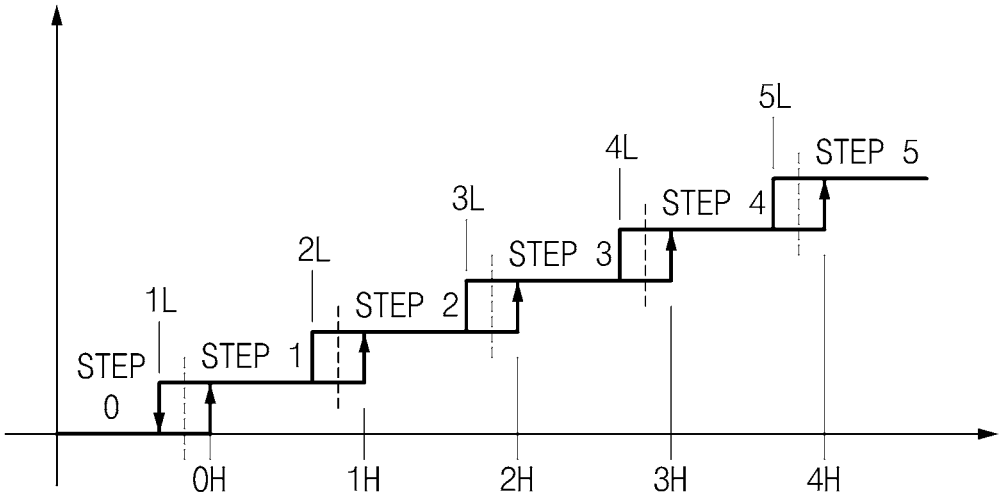
FIG. 13 is a graph for describing provision of hysteresis characteristic during speed setting, according to an exemplary embodiment of the present invention.

FIG. 12 is a diagram for describing a method for determining speed setting, according to an exemplary embodiment of the present invention. FIG. 13 is a graph for describing provision of hysteresis characteristic during speed setting, according to an exemplary embodiment of the present invention.

As illustrated in FIG. 3B, FIG. 12 illustrates an operation of a variable resistor for speed setting. In an exemplary embodiment of the present invention, a part of the entire operating range of a variable resistor is used. A voltage corresponding to the operating range is divided into six, and the voltage is converted into a digital value by an analog-to-digital converter of the processor 310.

In the instant case, in the case where an adjustment location is placed in a boundary between steps, for example, when the adjustment location is placed in a boundary between step 1 and step 2, the speed may be unstably set between two steps by a hand shake of a user or vibration of equipment. Accordingly, as illustrated in FIG. 12, the boundary between steps overlaps a part of a section, and as illustrated in FIG. 13, when the step is changed to the next step or the previous step, a hysteresis characteristic is provided.

Hereinafter, according to an exemplary embodiment of the present invention, a method of detecting speed setting will be described in detail with reference to FIG. 14.

Figure 14:
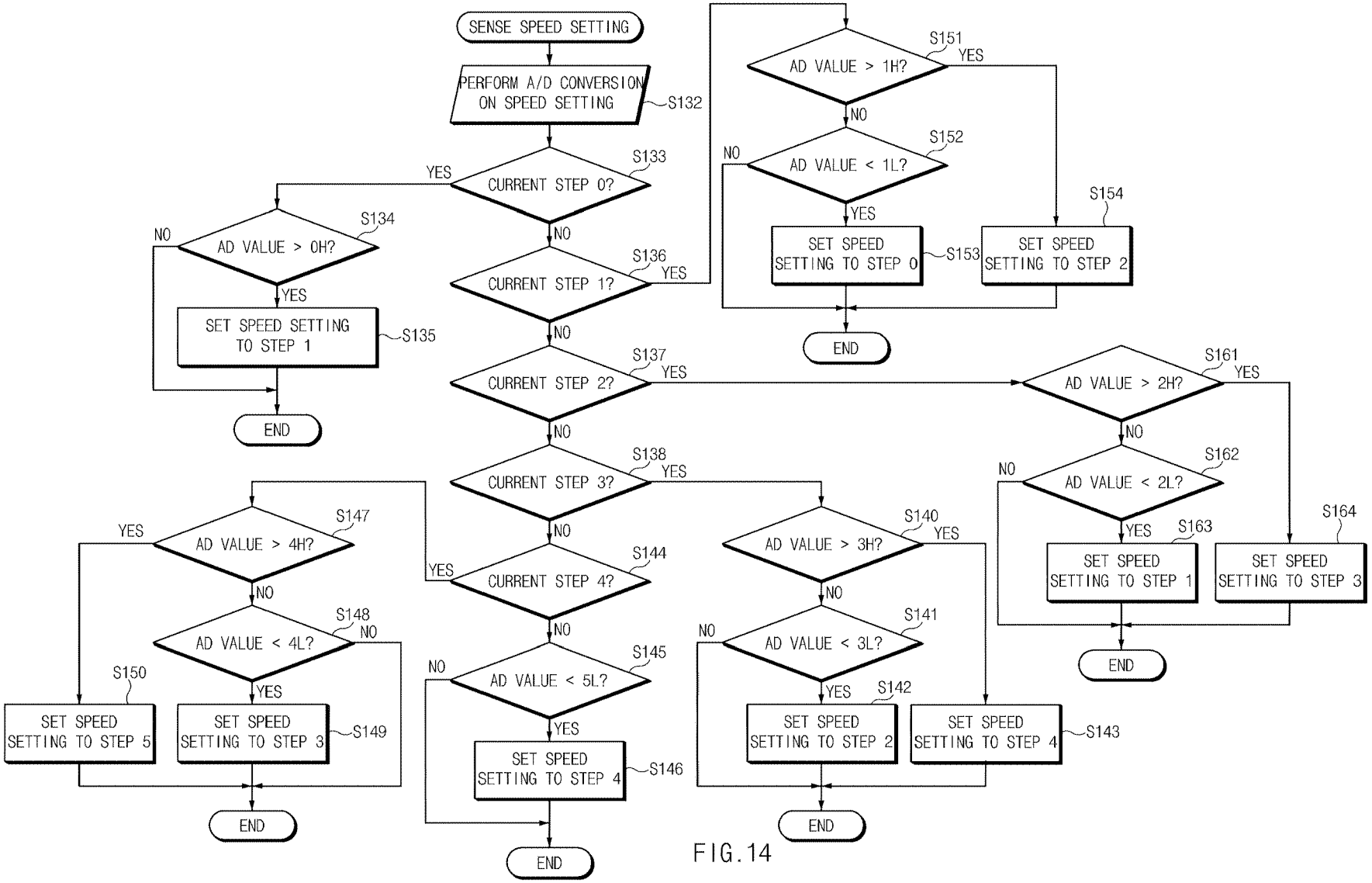
FIG. 14 is a flowchart illustrating a method of detecting speed setting, according to an exemplary embodiment of the present invention.

Referring to FIG. 14, a torque limit apparatus may perform analog-to-digital conversion on a torque setting port voltage to detect a location of a speed setting variable resistor in operation S131 and operation S132. In operation S133, the torque limit apparatus determines whether current speed setting is step 0, through a voltage value, which is converted as a digital value. When the current speed setting is step 0, in operation S134, the torque limit apparatus determines whether the newly converted voltage value is greater than OH. When the converted voltage value is not greater than OH, a routine is ended while the current speed setting is maintained as step 0. When the converted voltage value is greater than OH, in operation S135, the torque limit apparatus sets the current speed setting to step 1, and the routine is ended.

Meanwhile, in the case where the current speed setting is not step 0 in operation S133, in operation S136, the torque limit apparatus determines whether the current speed setting is step 1. When the current speed setting is step 1, in operation S151, the torque limit apparatus determines whether the converted value is greater than 1H. When the converted value is greater than 1H, in operation S154, the torque limit apparatus sets the current speed setting to step 2, and the routine is ended. On the other hand, when the converted voltage value is not greater than 1H, in operation S152, the torque limit apparatus determines whether the converted voltage value is less than 1L. When the converted voltage value is less than 1L, in operation S153, the torque limit apparatus sets the current speed setting to step 0. Otherwise, the routine is ended while step 1 is maintained.

Afterwards, in the case where the current speed setting is not step 1 in operation S136, in operation S137, the torque limit apparatus determines whether the current speed setting is step 2. When the current speed setting is step 2, in operation S161, the torque limit apparatus determines whether the converted value is greater than 2H. When the converted value is greater than 2H, in operation S164, the torque limit apparatus sets the current speed setting to step 3, and the routine is ended. On the other hand, when the converted voltage value is not greater than 2H, in operation S162, the torque limit apparatus determines whether the converted voltage value is less than 2L. When the converted voltage value is less than 2L, in operation S163, the torque limit apparatus sets the current speed setting to step 1. Otherwise, the routine is ended while step 2 is maintained.

Afterwards, in the case where the current speed setting is not step 2 in operation S137, in operation S138, the torque limit apparatus determines whether the current speed setting is step 3. When the current speed setting is step 3, in operation S140, the torque limit apparatus determines whether the converted value is greater than 3H. When the converted value is greater than 3H, in operation S143, the torque limit apparatus sets the current speed setting to step 4, and the routine is ended. On the other hand, when the converted voltage value is not greater than 3H, in operation S141, the torque limit apparatus determines whether the converted voltage value is less than 3L. When the converted voltage value is less than 3L, in operation S142, the torque limit apparatus sets the current speed setting to step 2. Otherwise, the routine is ended while step 3 is maintained.

Afterwards, in the case where the current speed setting is not step 3 in operation S138, in operation S144, the torque limit apparatus determines whether the current speed setting is step 4. When the current speed setting is step 4, in operation S147, the torque limit apparatus determines whether the converted value is greater than 4H. When the converted value is greater than 4H, in operation S150, the torque limit apparatus sets the current speed setting to step 5, and the routine is ended. On the other hand, when the converted voltage value is not greater than 4H, in operation S148, the torque limit apparatus determines whether the converted voltage value is less than 4L. When the converted voltage value is less than 4L, in operation S149, the torque limit apparatus sets the current speed setting to step 3. Otherwise, the routine is ended while step 3 is maintained.

In the meantime, in the case where the current speed setting is not step 4 in operation S144, in operation S145, the torque limit apparatus determines whether the converted voltage value is less than 5L. When the converted voltage value is less than 5L, in operation S146, the torque limit apparatus sets the current speed setting to step 4. Otherwise, the routine is ended while step 5 is maintained.

Figure 15A:
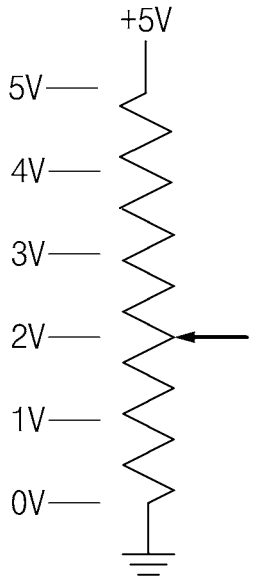
FIG. 15A is a diagram for describing a method for reading a torque setting variable resistor, according to an exemplary embodiment of the present invention.
Figure 15B:
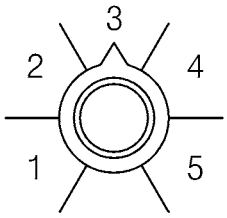
FIG. 15B is a diagram for describing torque setting of a torque setting device, according to an exemplary embodiment of the present invention.
Figure 15C:
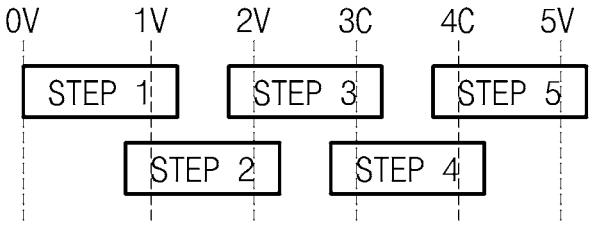
FIG. 15C is a diagram for describing a method for determining torque setting, according to an exemplary embodiment of the present invention.
Figure 16:
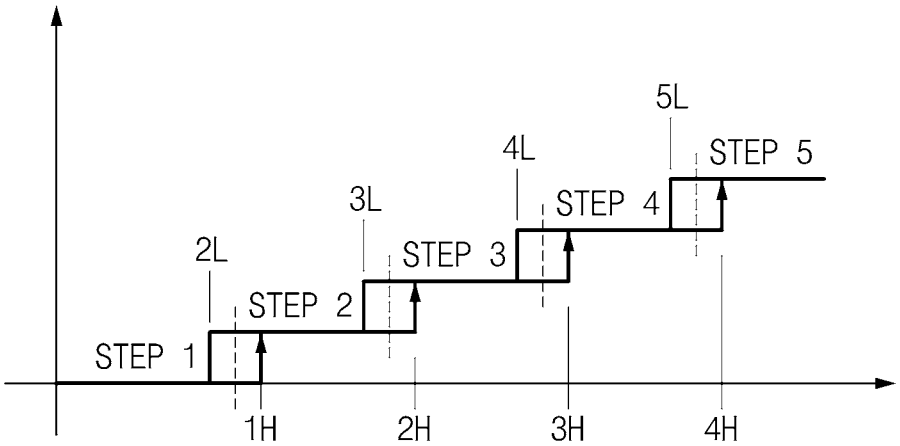
FIG. 16 a graph for describing constants of torque setting detecting step, according to an exemplary embodiment of the present invention.

FIG. 15A is a diagram for describing a method for reading a torque setting variable resistor, according to an exemplary embodiment of the present invention. FIG. 15B is a diagram for describing torque setting of a torque setting device, according to an exemplary embodiment of the present invention. FIG. 15C is a diagram for describing a method for determining torque setting step, according to an exemplary embodiment of the present invention. FIG. 16 a graph for describing constants of torque setting detecting step, according to an exemplary embodiment of the present invention.

Torque setting is detected by applying the same principle in the above-described speed setting. However, only a difference is to use the entire area of a variable resistor.

According to the above-described principle, since there are unstable factors in a boundary of a setting step, a hysteresis characteristic is provided by applying constants in FIG. 16. For example, in a state where current torque setting is step 3, the torque limit apparatus sets the current speed setting to step 2 when a value of the next detected variable resistor is less than 3L, and the torque limit apparatus sets the current speed setting to step 4 when a value of the next detected variable resistor is greater than 3H. The size of each of constants is determined as the optimal number by an experiment.

Figure 17:
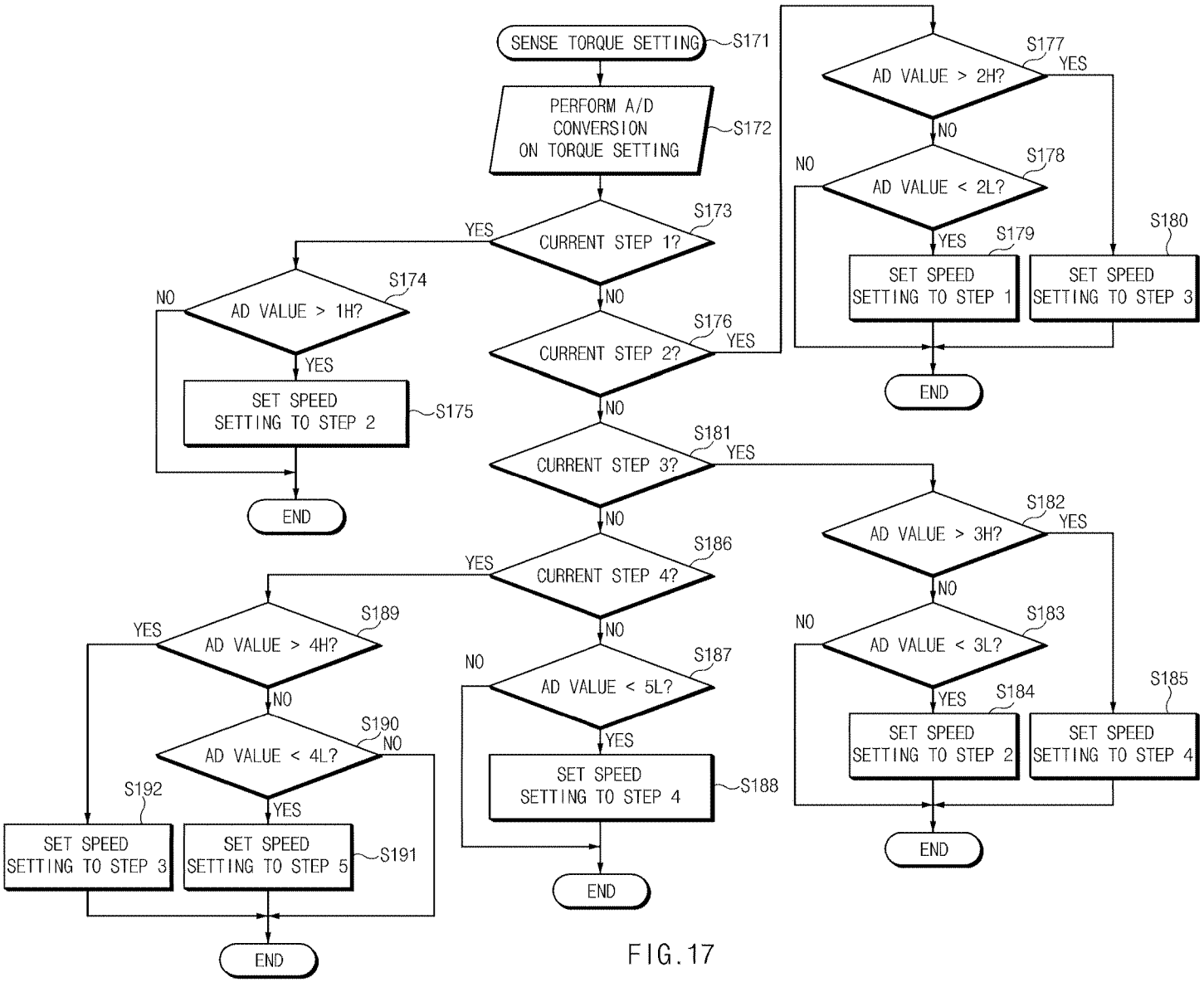
FIG. 17 is a flowchart illustrating a method of detecting torque setting, according to an exemplary embodiment of the present invention.

Hereinafter, according to an exemplary embodiment of the present invention, a method of detecting torque setting will be described with reference to FIG. 17.

A torque limit apparatus may perform analog-to-digital conversion on a torque setting port voltage to detect a location of a torque setting variable resistor in operation S171 and operation S172.

Afterwards, in operation S173, the torque limit apparatus determines whether torque setting is currently step 1. When the torque setting is currently step 1, in operation S174, the torque limit apparatus determines whether the converted value is greater than 1H. When the converted value is greater than 1H, in operation S175, the torque limit apparatus sets the torque setting to step 2, and the routine is ended. On the other hand, when the converted value is not greater than 1H, a routine is ended while step 1 is maintained.

Afterwards, in the case where the torque setting is not step 1 in operation S173, in operation S176, the torque limit apparatus determines whether the torque setting is currently step 2. When the torque setting is currently step 2, in operation S177, the torque limit apparatus determines whether the converted value is greater than 2H. When the converted value is greater than 2H, in operation S180, the torque limit apparatus sets the torque setting to step 3, and the routine is ended. On the other hand, when the converted voltage value is not greater than 2H, in operation S178, the torque limit apparatus determines whether the converted voltage value is less than 2L. When the converted voltage value is less than 2L, in operation S179, the torque limit apparatus sets the torque setting to step 1. Otherwise, the routine is ended while step 2 is maintained.

Afterwards, in the case where the torque setting is not step 2 in operation S176, in operation S181, the torque limit apparatus determines whether the torque setting is step 3. When the torque setting is step 3, in operation S182, the torque limit apparatus determines whether the converted value is greater than 3H. When the converted value is greater than 3H, in operation S185, the torque limit apparatus sets the torque setting to step 4, and the routine is ended. On the other hand, when the converted voltage value is not greater than 3H, in operation S183, the torque limit apparatus determines whether the converted voltage value is less than 3L. When the converted voltage value is less than 3L, in operation S184, the torque limit apparatus sets the torque setting to step 2. Otherwise, the routine is ended while step 3 is maintained.

Afterwards, in the case where the torque setting is not step 3 in operation S181, in operation S186, the torque limit apparatus determines whether the torque setting is step 4. When the torque setting is step 4, in operation S189, the torque limit apparatus determines whether the converted voltage value is greater than 4H. When the converted voltage value is greater than 4H, in operation S192, the torque limit apparatus sets the torque setting to step 5, and the routine is ended. On the other hand, when the converted voltage value is not greater than 4H, in operation S190, the torque limit apparatus determines whether the converted voltage value is less than 4L. When the converted voltage value is less than 4L, in operation S191, the torque limit apparatus sets the torque setting to step 3. Otherwise, the routine is ended while step 4 is maintained.

In the meantime, in the case where the torque setting is not step 4 in operation S186, in operation S187, the torque limit apparatus determines whether the converted voltage value is less than 5L. When the converted voltage value is less than 5L, in operation S188, the torque limit apparatus sets the torque setting to step 4. Otherwise, the routine is ended.

Figure 18:
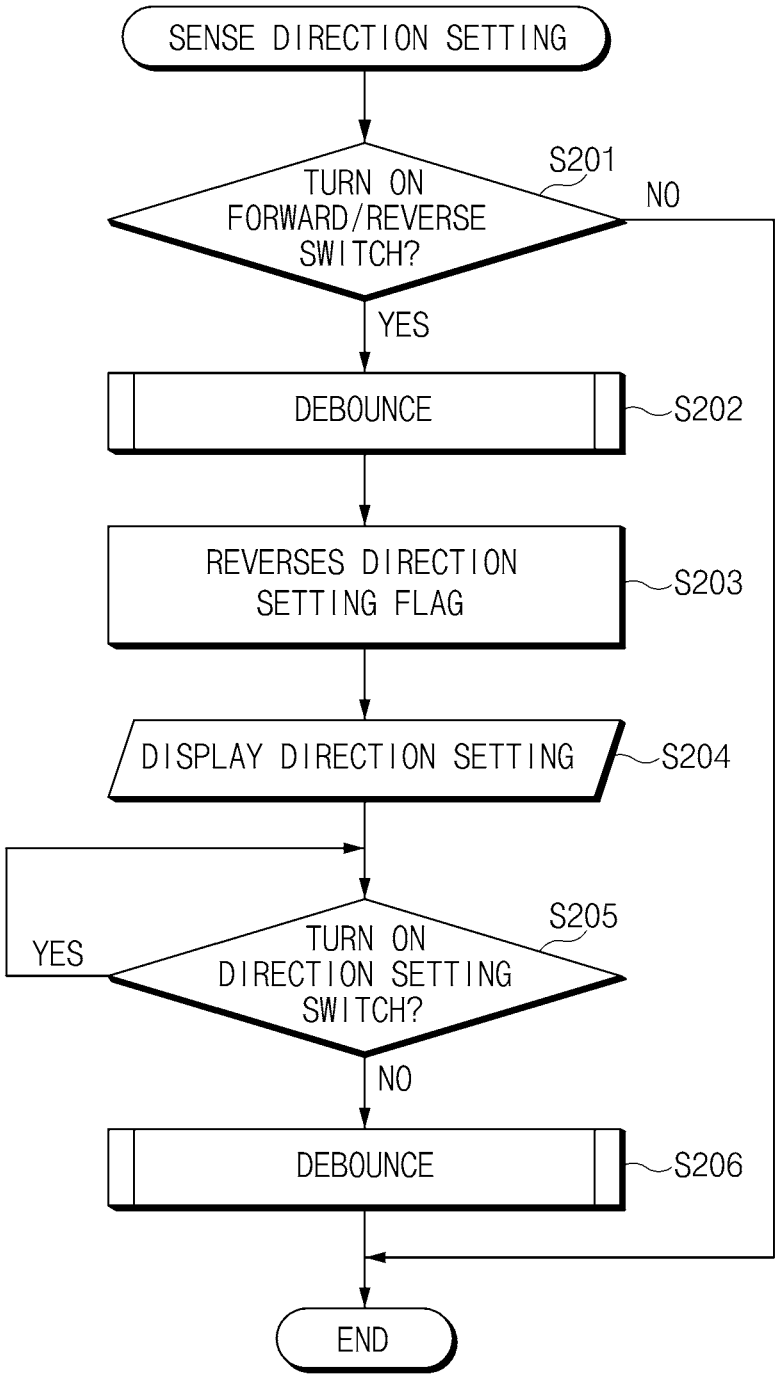
FIG. 18 is a flowchart illustrating a method of detecting direction setting, according to an exemplary embodiment of the present invention.

Hereinafter, according to an exemplary embodiment of the present invention, a method of detecting direction setting will be described with reference to FIG. 18.

When a user employs an electric screwdriver in a forward direction or a reverse direction, a torque limit apparatus detects the direction depending on a routine of detecting a direction setting.

In operation S201, the torque limit apparatus determines whether the user presses a direction setting switch SW1. When the user does not press the direction setting switch SW1, the routine is ended. When it is determined that the user presses the direction setting switch SW1, in operation S202, the torque limit apparatus performs debounce that delays by about 20~100 ms to remove mechanical chattering occurring at the direction setting switch SW1, and, in operation S203, the torque limit apparatus reverses a forward/reverse flag. That is, when the user employed the electric screwdriver in the forward direction, the torque limit apparatus changes the direction to the reverse direction thereof. Alternatively, when the user employed the electric screwdriver in the reverse direction, the torque limit apparatus changes the direction to the forward direction thereof.

When being completely reversed, in operation S204, the torque limit apparatus displays direction setting to the output device 140. In operation S205, the torque limit apparatus detects whether the user presses the switch. When the user continuously presses the switch, the torque limit apparatus waits until the user releases his or her hand. When the user releases his or her hand from the direction setting switch, that is, the switch is turned off, the routine is ended after chattering occurring mechanically is removed.

Figure 19:
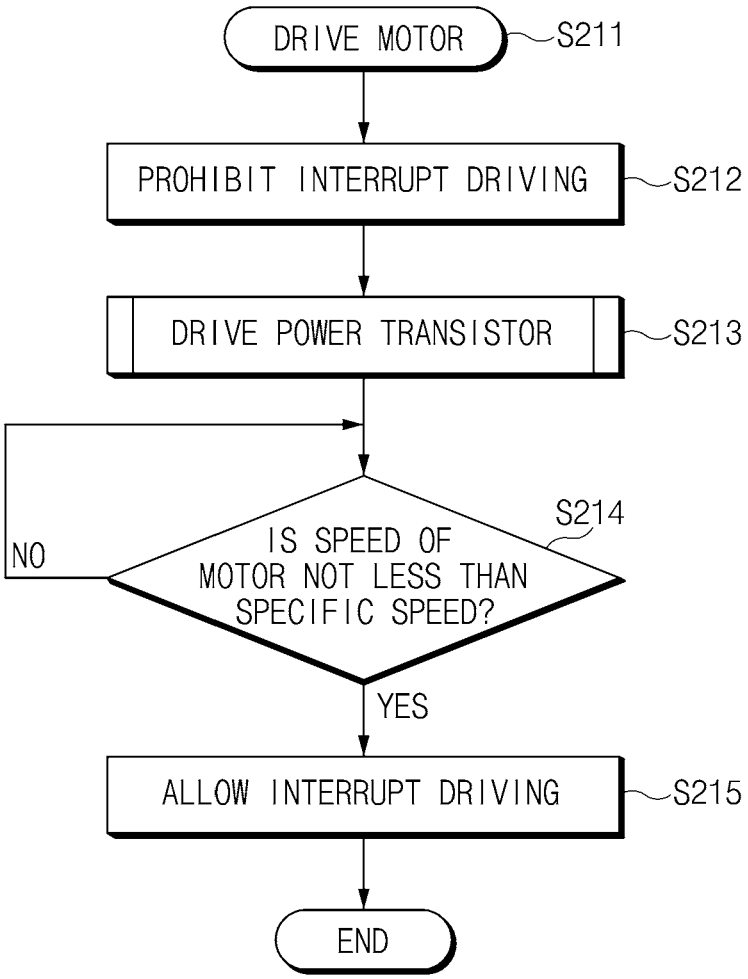
FIG. 19 is a flowchart illustrating a method of driving a motor, according to an exemplary embodiment of the present invention.

Hereinafter, according to an exemplary embodiment of the present invention, a motor driving method will be described with reference to FIG. 19. The transistor driving method of FIG. 19 will be described with reference to FIG. 20.

A method of driving a BLDC motor used in an exemplary embodiment of the present invention includes generating, by the processor 310, an interrupt by the change in the detection signal of the position detector when a detection signal of the position detector 330 (a rotor position sensor) is changed while the motor rotates, and turning on/off the power transistors 320 corresponding to the detection signal of the position detector changed in an interrupt routine. In the case where the BLDC motor is driven by the method, when a main program of the processor 310 controls only PWM, it may be handled as when the BLDC motor 400 rotates automatically without separate control. Speed is automatically detected during automatic driving by the interrupt.

Firstly, to drive the motor in operation S211, in a state where interrupt driving is prohibited in operation S212, a power transistor is driven in operation S213. Whether the speed of the motor is not less than a specific speed is determined in operation S214. In the case where the speed of the motor is not less than the specific speed, interrupt driving is allowed in operation S215.

As described above, in a method in which the motor 400 is automatically driven by interrupt, the motor 400 does not automatically rotate in an initial time point when the motor 400 is driven. That is, since the motor 400 does not rotate, the interrupt is not generated. Also, since the interrupt is not generated, on/off control of the power transistor 320 is not performed. Accordingly, the motor 400 does not still rotate. Accordingly, as in an operation of initially starting a vehicle engine, there is a need for an operation of initially starting a motor. When the speed of the motor reaches a specific speed once starting the motor, the interrupt is continuously generated, and thus the state of the motor is changed to an automatic driving state by the interrupt.

A method of driving a BLDC motor rotates the motor 400 while an operation of detecting a position detector detection signal in the software manner and controlling to turn on/off the power transistor 320 corresponding to the detected position detector detection signal in a state where the motor needs to start by a main program and changes the control to start the driving by the interrupt when the speed of the motor reaches a specific speed or more.

A pin-change interrupt (PCINT) interrupt may be an interrupt occurring when one of three rotor position detection signals is changed, and a driving routine of the BLDC motor may be performed whenever the PCINT interrupt occurs. When the interrupt occurs, the current rotor position detection signal is read to turn on/off the corresponding transistor.

When one of the three rotor position detection signals is changed when the BLDC motor is driven, the interrupt occurs. Accordingly, speed may be detected by counting how many times the interrupt occurs during a specific time period. As a result, the motor speed is always recorded automatically in a detected speed variable by an operation of increasing a speed counter value whenever the PCINT is processed by the rotor position detection signal, storing a speed counter value in the detected speed variable by periodically extracting the speed counter value in separate timer interrupt, and initializing the speed counter.

Figure 20:
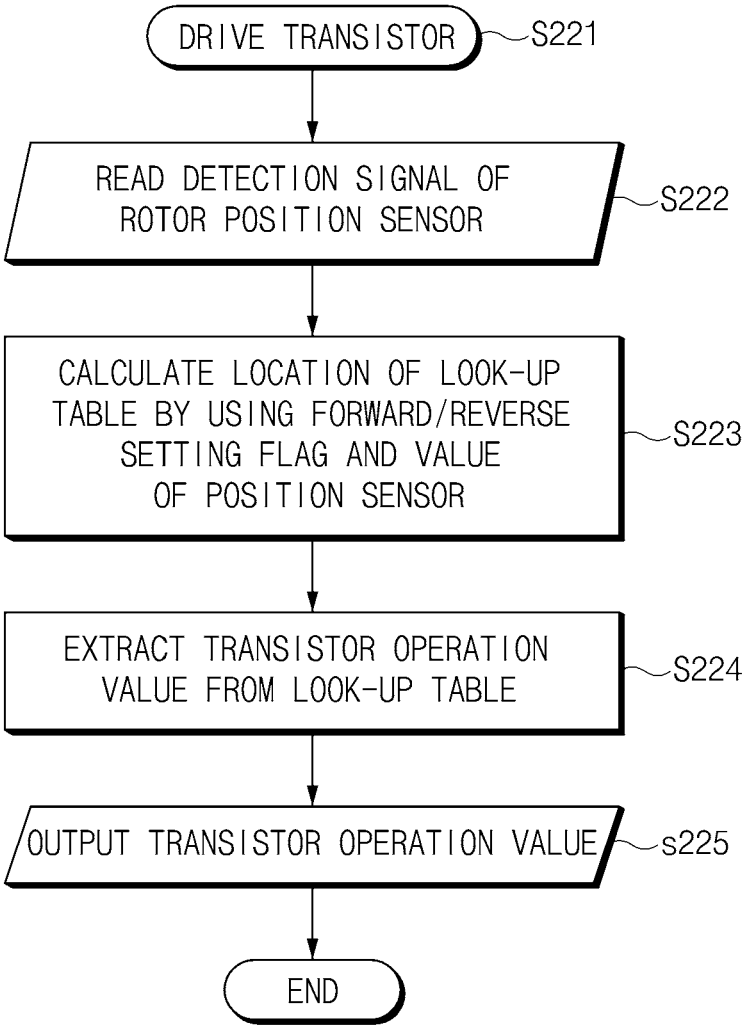
FIG. 20 is a flowchart illustrating a method of driving the transistor of FIG. 19.

Referring to FIG. 20, to drive a transistor in operation S221, in operation S222, a torque limit apparatus reads a detection signal of a rotor position sensor. In operation S223, the torque limit apparatus determines a location of a look-up table by use of a direction setting flag and a value of a position sensor. In operation S224, the torque limit apparatus extracts a transistor operation value from the look-up table. Finally, in operation S225, the torque limit apparatus outputs the transistor operation value.

Figure 21:
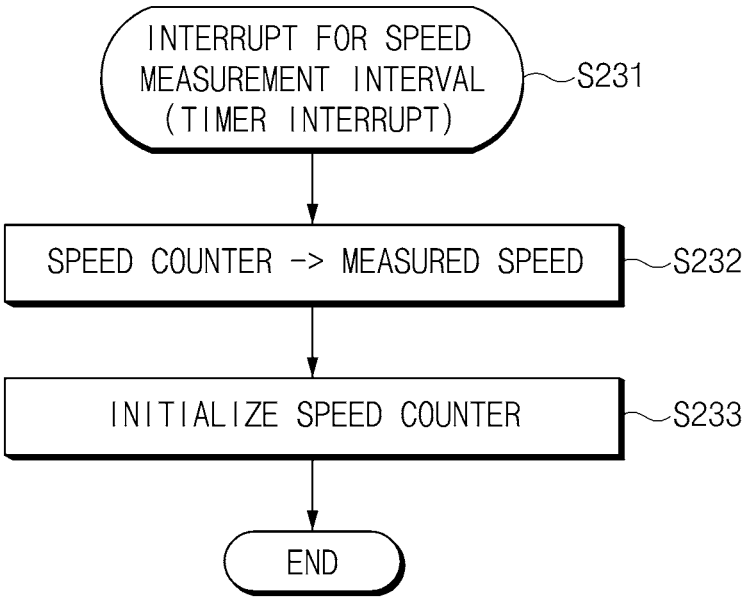
FIG. 21 is a flowchart illustrating a timer interrupt processing method, according to an exemplary embodiment of the present invention.

FIG. 21 is a flowchart illustrating a timer interrupt processing method, according to an exemplary embodiment of the present invention.

Referring to FIG. 21, a routine for a speed measurement interval (timer interrupt) is illustrated.

An interrupt for the speed measurement interval is generated from a timer/counter circuit of the processor 310, and automatically is generated at specific intervals. Referring to FIG. 21, when the timer interrupt occurs in operation S231, after a speed counter value accumulated until now is copied to a variable for storing the finally measured speed result in operation S232, in operation S233, a speed counter is initialized and ended to measure new speed. That is, the speed counter value increasing from a point in time when the interrupt occurs to a point in time when the next interrupt occurs is extracted.

Figure 22:
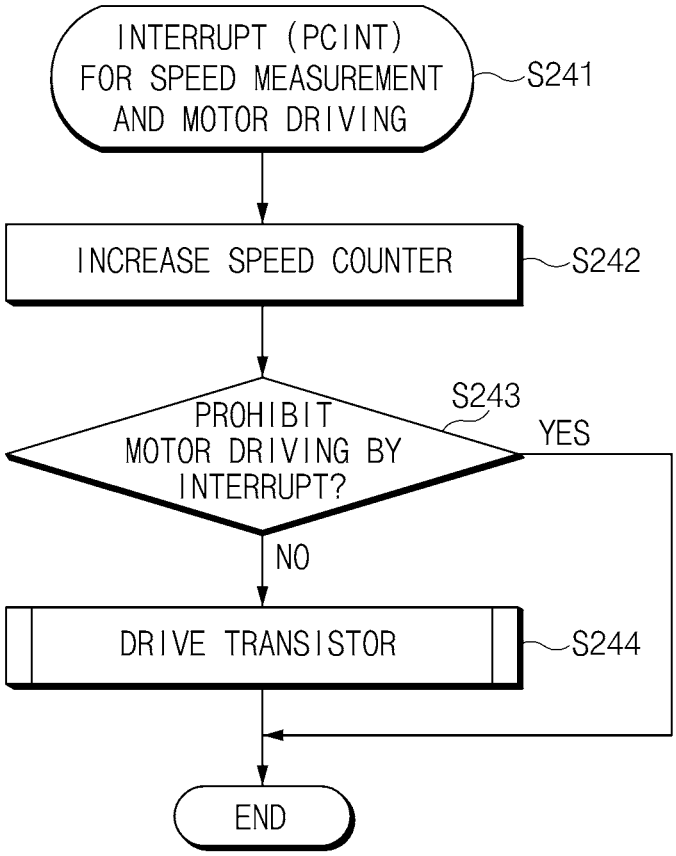
FIG. 22 is a flowchart illustrating an interrupt processing method of a rotor position sensor, according to an exemplary embodiment of the present invention.

FIG. 22 is a flowchart illustrating an interrupt processing method of a rotor position sensor, according to an exemplary embodiment of the present invention.

FIG. 22 illustrates speed measurement and motor driving routine PCINT. Referring to FIG. 22, a PCINT routine may be driven by an interrupt occurring whenever an output of a rotor position detector is changed. When the routine is entered in operation S241, a speed counter increases in operation S242. In operation S243, when it is verified in operation S243 that motor driving is prohibited by the interrupt of other routines, the routine is ended. Otherwise, in operation S244, after being performed to control a transistor depending on the currently changed state of the rotor position sensor, the above-described transistor driving routine is ended.

Accordingly, in an exemplary embodiment of the present invention, flame, dust, noise, durability, and life of a BLDC motor are improved by use of the BLDC motor without using a universal motor. The volume and weight may be reduced by replacing a mechanical torque limit apparatus by an electric torque limit apparatus.

In addition, the present invention limits torque by estimating the torque through a relation between RPM of the BLDC motor and PWM duty command. The convenience of the user increases by including an interface that allows a user to adjust a torque limit size. The convenience of the user increases by including a control algorithm that allows an electric screwdriver to rotate by 2~3 degrees such that the electric screwdriver is released from a screw after the electric screwdriver tightens the screw.

In addition, it may be possible to measure a motor torque state without a separate current detector and a shunt resistor. The convenience of the user increases by automatically stopping a motor and providing notification that the motor is stopped through alarm when current torque of a motor reaches set torque.

Figure 23:
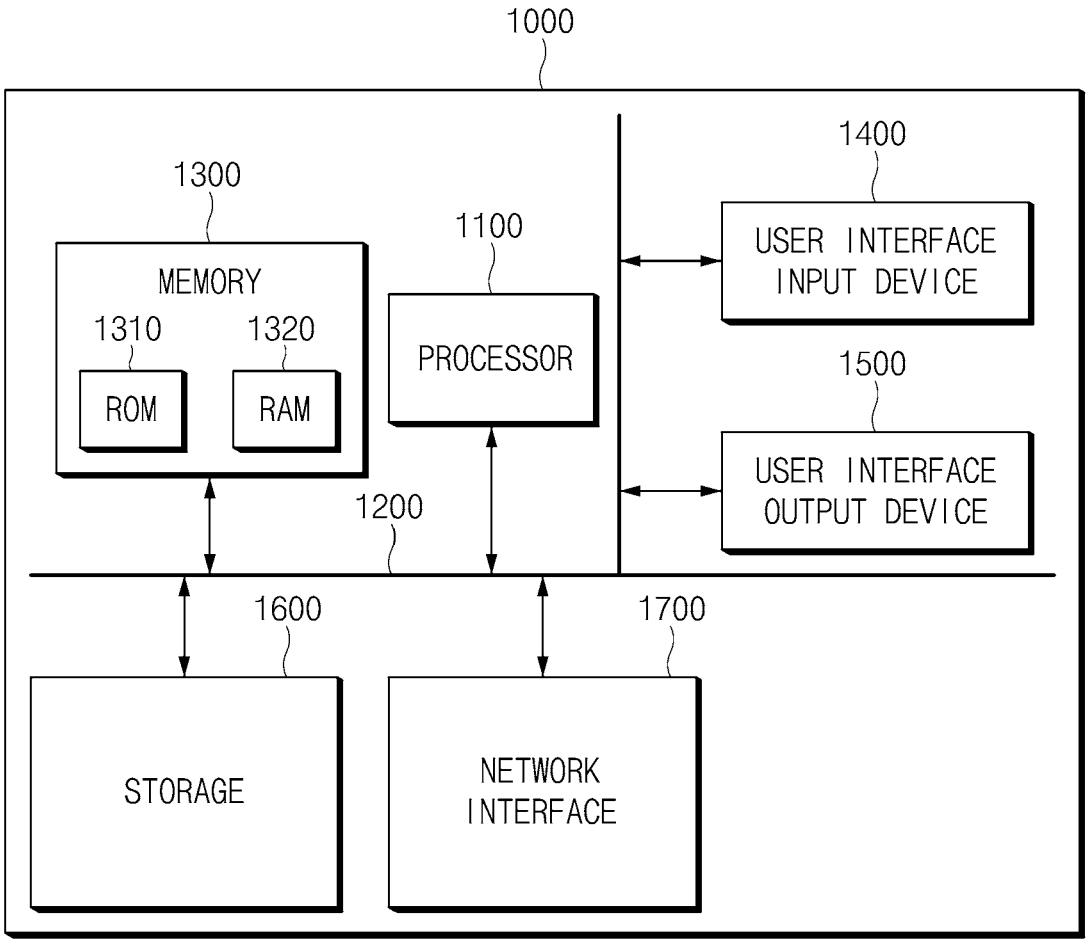
FIG. 23 is a block diagram illustrating a computer system, to which a torque limiting method of a BLDC electric screwdriver is applied, according to an exemplary embodiment of the present invention.

FIG. 23 is a block diagram illustrating a computer system, to which a torque limiting method of a BLDC electric screwdriver is applied, according to an exemplary embodiment of the present invention.

Referring to FIG. 23, a computing system 1000 may include at least one processor 1100, a memory 1300, a user interface input device 1400, a user interface output device 1500, a storage 1600, and a network interface 1700, which are connected to each other via a bus 1200.

The processor 1100 may be a central processing unit (CPU) or a semiconductor device that processes instructions stored in the memory 1300 and/or the storage 1600. Each of the memory 1300 and the storage 1600 may include various types of volatile or non-volatile storage media. For example, the memory 1300 may include a read only memory (ROM) and a random access memory (RAM).

Thus, the operations of the methods or algorithms described with reference to the embodiments included in the specification may be directly implemented with a hardware module, a software module, or combinations thereof, executed by the processor 1100. The software module may reside on a storage medium (e.g., the memory 1300 and/or the storage 1600) including a RAM, a flash memory, a ROM, an erasable and programmable ROM (EPROM), an electrically EPROM (EEPROM), a register, a hard disc, a removable disc, or a compact disc-ROM (CD-ROM).

The storage medium may be coupled to the processor 1100. The processor 1100 may read out information from the storage medium and may write information in the storage medium. Alternatively, the storage medium may be integrated with the processor 1100. The processor and storage medium may reside in an application specific integrated circuit (ASIC). The ASIC may reside in a user terminal. Alternatively, the processor and storage medium may reside as a separate component in the user terminal.

The present technology may include an interface that allows a user to adjust torque limit magnitude of a torque limit apparatus of a BLDC motor, increasing inconvenience of a user. In addition, the present technology may perform electric torque limit by estimating torque through a variance in PWM of a BLDC motor without a separate sensor, decreasing the volume and weight of the motor.

Hereinabove, although the present invention has been described with reference to exemplary embodiments and the accompanying drawings, the present invention is not limited thereto, but may be variously modified and altered by those skilled in the art to which the present invention pertains without departing from the spirit and scope of the present invention claimed in the following claims.

For convenience in explanation and accurate definition in the appended claims, the terms "upper", "lower", "internal", "outer", "up", "down", "upper", "lower", "upwards", "downwards", "front", "rear", "back", "inside", "outside", "inwardly", "outwardly", "internal", "external", "internal", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A torque limit apparatus comprising:

a user interface device configured to receive a speed setting value and a torque setting value of a motor from a user and to output a state of the motor; and a motor control device configured to control speed of the motor depending on the speed setting value set by the user and to interrupt an operation of the motor when torque of the motor reaches the torque setting value set by the user, wherein the user interface device includes:

a speed setting device configured to receive the speed setting value of the motor from the user; and a torque setting device that is configured to receive the torque setting value of the motor, wherein each of the speed setting device and the torque setting device is configured to divide in to a plurality of steps using a variable resistor, and configured to overlap predetermined sections of a boundary between adjacent steps among the plurality of steps, and wherein when one of the adjacent steps is changed to another of the adjacent steps, a hysteresis characteristic is provided.

2. The torque limit apparatus of claim 1, wherein the speed setting device includes:

a trigger-type handle, a location of which is adjustable by the user, and the variable resistor coupled to the trigger-type handle, and wherein the speed setting device divides the speed of the motor into a plurality of steps and sets the speed of the motor to one of the plurality of steps by moving the trigger-type handle.

3. The torque limit apparatus of claim 1, wherein the torque setting device includes:

a circular member, an orientation of which is adjustable by the user; and the variable resistor coupled to the circular member, and wherein the torque setting device divides the torque into a plurality of steps and sets the torque to one of the plurality of steps by moving the circular member.

4. The torque limit apparatus of claim 1, wherein the user interface device further includes:

a direction setting switch configured to receive a direction of rotation of the motor by the user.

5. The torque limit apparatus of claim 4, wherein the direction setting switch is a single single-pole single-throw (SPST) push switch.

6. The torque limit apparatus of claim 1, wherein the user interface device further includes:

an output device configured to display the state of the motor and to output alarm when the torque of the motor reaches the torque setting value set by the torque setting device while the motor is driven.

7. The torque limit apparatus of claim 1, wherein the motor control device determines that a screw is tightened by the motor, and outputs alarm sound or an alarm lamp through the user interface device, when the torque of the motor reaches the torque setting value set by the user.

8. The torque limit apparatus of claim 7, wherein the motor control device rotates the motor by a predetermined angle in a reverse direction when the screw is determined to be tightened by the motor.

9. The torque limit apparatus of claim 1, wherein the motor control device includes:

a power transistor configured to output a pulse width modulation (PWM) signal for determining rotation speed of the motor to the motor;

a position detector configured to detect the rotation speed of the motor; and a processor, wherein the processor is configured to:

drive the power transistor depending on the speed setting value set by the user;

control the power transistor such that the rotation speed of the motor detected by the position detector is a same as the speed setting value set by the user; and interrupt the operation of the motor when the torque of the motor reaches the torque setting value set by the user.

10. The torque limit apparatus of claim 9, wherein the processor is configured:

to receive detected rotational speed of the motor detected from the position detector;

to compare the rotation speed with the speed setting value set by the user;

to output a value for determining a PWM duty cycle depending on a result of the comparing; and to compare torque set depending on the output value with the torque setting value set by the user.

11. The torque limit apparatus of claim 10, wherein the processor is configured to output alarm sound or to turn on an alarm lamp through the user interface device when the torque set depending on the output value a same as the torque setting value set by the user.

12. The torque limit apparatus of claim 1, further comprising:

a power supply device configured to power the motor.

13. A brushless DC (BLDC) electric screwdriver comprising:

a BLDC motor; and a torque limit apparatus, wherein the torque limit apparatus is configured to:

receive a speed setting value and a torque setting value of the BLDC motor from a user;

compare detected speed of the BLDC motor with the speed setting value set by the user to output a pulse width modulation (PWM) signal for the BLDC motor speed control;

compare torque detected from a variation of the PWM signal with the torque setting value set by the user; and when the torque detected from the variation of the PWM signal is a same as the torque setting value set by the user, interrupt an operation of the BLDC motor, wherein the torque limit apparatus includes:

a speed setting device configured to receive the speed setting value of the BLDC motor from the user; and a torque setting device that is configured to receive the torque setting value of the motor, wherein each of the speed setting device and the torque setting device is configured to divide in to a plurality of steps using a variable resistor, and configured to overlap predetermined sections of a boundary between adjacent steps among the plurality of steps, and wherein when one of the adjacent steps is changed to another of the adjacent steps, a hysteresis characteristic is provided.

14. A torque limit method, the method comprising:

receiving a speed setting value and a torque setting value of a motor from a user;

detecting the speed setting value and the torque setting value of the motor from the user;

detecting a current speed of the motor;

comparing the current speed of the motor with the speed setting value set by the user to control speed of the motor;

detecting a current torque of the motor;

interrupting an operation of the motor when the current torque of the motor reaches the torque setting value set by the user;

wherein detecting a speed setting value and a torque setting value of a motor from a user includes:

dividing in to a plurality of steps using a variable resistor, overlapping predetermined sections of a boundary between adjacent steps among the plurality of steps, providing a hysteresis characteristic when one of the adjacent steps is changed to another of the adjacent steps.

15. The method of claim 14, further comprising:

outputting a state of the motor by use of alarm sound or an alarm lamp.

16. The method of claim 15, wherein the detecting of the current speed of the motor includes:

detecting the torque by use of a variance of PWM duty cycle for driving the motor that is based on a result obtained by comparing the current speed of the motor with the speed setting value set by the user.

17. The method of claim 16, wherein the interrupting of the operation of the motor includes:

decreasing an excess counter variable when torque excess in which the current torque of the motor is greater than the torque setting value set by the user is detected;

determining that the current torque of the motor definitively reaches the torque setting value set by the user, when the excess counter variable is "0"; and initializing the excess counter variable when the determination is completed.

18. The method of claim 15, further comprising:

rotating the motor by a predetermined angle in a reverse direction when the motor is interrupted when the current torque of the motor reaches the torque setting value set by the user.

19. The method of claim 14, wherein the controlling of the speed of the motor includes:

decreasing a pulse width modulation (PWM) pulse width for driving the motor when the current speed of the motor is greater than the speed setting value set by the user; and increasing the pulse width modulation (PWM) pulse width for driving the motor when the current speed of the motor is less than the speed setting value set by the user.

* * * * *